US011104019B2

(12) United States Patent
Kole et al.

(10) Patent No.: US 11,104,019 B2
(45) Date of Patent: Aug. 31, 2021

(54) RAZOR ASSEMBLY

(71) Applicant: RK INVENTIONS, LLC, Glencoe, IL (US)

(72) Inventors: Ryan Kole, Glencoe, IL (US); Matthew Spenko, Chicago, IL (US); Vincent Bowman, Highland Park, IL (US)

(73) Assignee: RK INVENTIONS, LLC, Glencoe, IL (US)

( * ) Notice: Subject to any disclaimer, the term of this patent is extended or adjusted under 35 U.S.C. 154(b) by 0 days.

(21) Appl. No.: 16/892,772

(22) Filed: Jun. 4, 2020

(65) Prior Publication Data

US 2020/0290223 A1 Sep. 17, 2020

Related U.S. Application Data

(63) Continuation of application No. 15/982,825, filed on May 17, 2018, now Pat. No. 10,828,793, which is a (Continued)

(51) Int. Cl.
*B26B 21/42* (2006.01)
*B26B 21/40* (2006.01)
(Continued)

(52) U.S. Cl.
CPC ..... *B26B 21/42* (2013.01); *B26B 21/02* (2013.01); *B26B 21/222* (2013.01);
(Continued)

(58) Field of Classification Search
CPC . B26B 21/42; B26B 21/4062; B26B 21/4018; B26B 21/185; B26B 21/565;
(Continued)

(56) References Cited

U.S. PATENT DOCUMENTS 2,256,076 A 9/1941 Coles
2,350,121 A 5/1944 McCaskey
(Continued)

FOREIGN PATENT DOCUMENTS

DE 102004020650 A1 11/2005
DE 102009005811 A1 7/2010
(Continued)

OTHER PUBLICATIONS

International Search Report and Written Opinion for co-pending International PCT/2019/31676, dated Jul. 22, 2019.

*Primary Examiner* — Laura M Lee
(74) *Attorney, Agent, or Firm* — Leydig, Voit & Mayer, Ltd.

(57) ABSTRACT

One or more implementation disclosed herein provides razor assemblies that allow a user to have a less than smooth shave by changing the distance between razor blades and a razor blade guard. The distance between the razor blade(s) and the guard may be increased or decreased using a movable knob mechanism, a rotatable dial mechanism, a movable razor assembly and housing mechanism, a rotatable threaded handle, one or more slider mechanisms, a rotating blade mechanism, etc.

14 Claims, 35 Drawing Sheets

Related U.S. Application Data continuation-in-part of application No. 15/098,349, filed on Apr. 14, 2016, now abandoned.

(60) Provisional application No. 62/148,165, filed on Apr. 15, 2015.

(51) Int. Cl.
*B26B 21/22* (2006.01)
*B26B 21/02* (2006.01)

(52) U.S. Cl.
CPC ..... *B26B 21/227* (2013.01); *B26B 21/4018* (2013.01); *B26B 21/4062* (2013.01)

(58) Field of Classification Search
CPC ..... B26B 21/222; B26B 21/02; B26B 21/227; B26B 19/20; B26B 5/001; B26B 5/006
USPC ..... 30/30, 54, 60, 61, 62, 63, 71, 79, 162, 30/335, 60.5
See application file for complete search history.

(56) References Cited

U.S. PATENT DOCUMENTS 2,488,436 A 11/1949 Santoro
2,597,653 A 5/1952 Mansfield
2,612,684 A * 10/1952 Mansfield ..... B26B 21/42 30/31
2,753,627 A 7/1956 Isroff
3,008,233 A 11/1961 Waggoner
3,107,423 A 10/1963 Caesar
3,178,815 A 4/1965 Madrid
3,263,328 A 8/1966 Craig
3,413,720 A 12/1968 Mullen
3,657,810 A 4/1972 Nissen
3,754,325 A 8/1973 Tornvalls
3,816,913 A * 6/1974 Ferraro ..... B26B 21/24 30/47
3,816,916 A * 6/1974 Kuhnl ..... B26B 21/24 30/47
3,855,700 A 12/1974 Gerson et al.
3,892,036 A 7/1975 Perry
4,011,656 A 3/1977 Liedtke
4,085,503 A 4/1978 Beck et al.
4,241,500 A 12/1980 Iten
4,319,399 A 3/1982 Ciaffone
4,441,252 A 4/1984 Caves
4,558,517 A 12/1985 Gringer
4,776,095 A 10/1988 Tsujimoto et al.
4,845,852 A 7/1989 Sukow
4,949,460 A 8/1990 Sterk
4,976,028 A * 12/1990 Chen ..... B26B 21/4012 30/49
4,996,772 A * 3/1991 Iten ..... B26B 21/4037 30/123.3
5,060,380 A 10/1991 Fujikawa
5,207,696 A 5/1993 Matwijcow
5,386,750 A 2/1995 Morrison
5,410,810 A * 5/1995 Gillibrand ..... B26B 21/4025 30/41
5,433,004 A 7/1995 Thompson et al.
5,493,778 A * 2/1996 Ichiyanagi ..... B26B 21/4006 30/41
5,557,851 A * 9/1996 Ortiz ..... B26B 21/227 30/50
5,713,232 A 2/1998 Hodge
6,263,576 B1 * 7/2001 Drapak ..... B26B 21/14 30/48
6,276,060 B1 8/2001 Faulstich et al.
6,286,215 B1 9/2001 Panaccione
6,418,623 B1 * 7/2002 Marcarelli ..... B26B 21/22 30/34.1
6,568,084 B2 * 5/2003 McCool ..... B26B 21/222 30/50
6,618,948 B2 9/2003 Lin
7,234,242 B2 6/2007 Yao
7,475,481 B1 1/2009 Napoli
D630,377 S 1/2011 Wattam et al.
8,465,512 B2 6/2013 Rosenhan
8,555,509 B2 * 10/2013 Pohl ..... B26B 19/14 30/43.92
8,584,848 B1 11/2013 Lee et al.
8,661,687 B2 3/2014 Rebaudieres et al.
8,739,411 B2 6/2014 Kinghorn et al.
8,844,142 B2 9/2014 Kammer
D722,201 S 2/2015 Boulanger
D754,399 S 4/2016 Andersson
9,592,613 B2 * 3/2017 Pohl ..... B26B 19/04
9,751,226 B2 9/2017 Psimadas et al.
9,919,441 B2 3/2018 Drori
10,040,208 B2 8/2018 Darwinkel et al.
10,105,856 B2 10/2018 Tuijpn et al.
10,144,142 B1 12/2018 Squires et al.
10,307,920 B1 6/2019 Sanchez
10,730,197 B2 * 8/2020 Iaccarino ..... B26B 19/063
10,780,596 B2 * 9/2020 Squires ..... B26B 21/4037
10,828,793 B2 * 11/2020 Kole ..... B26B 21/523
10,843,356 B2 * 11/2020 Lee ..... B26B 21/4025
2002/0046465 A1 * 4/2002 McCool ..... B26B 21/222 30/50
2003/0033717 A1 2/2003 Cecil
2003/0136006 A1 7/2003 Lin
2006/0042095 A1 * 3/2006 Yamaguchi ..... B26B 19/3853 30/201
2007/0204469 A1 9/2007 Caric et al.
2008/0047145 A1 2/2008 Dietzel et al.
2008/0078333 A1 4/2008 Wang
2008/0250644 A1 10/2008 Orloff et al.
2009/0007442 A1 1/2009 Kurihara
2009/0188117 A1 7/2009 Putzer
2010/0058595 A1 3/2010 Walker, Jr. et al.
2011/0088268 A1 4/2011 Marut
2011/0094108 A1 4/2011 Wain
2011/0203124 A1 8/2011 Bridges et al.
2013/0199346 A1 8/2013 Psimadas et al.
2015/0342319 A1 12/2015 Lee et al.
2016/0346944 A1 * 12/2016 Sadrialaei ..... B26B 21/4031
2017/0210020 A1 7/2017 Bozikis et al.
2017/0266825 A1 * 9/2017 Bozikis ..... B26B 21/4031
2017/0355090 A1 12/2017 Spencer et al.
2018/0085943 A1 * 3/2018 Bady ..... B26B 19/3813
2018/0085944 A1 * 3/2018 Bady ..... B26B 19/20
2018/0085945 A1 * 3/2018 Bady ..... B26B 19/143
2020/0338770 A1 * 10/2020 Moustakas ..... B26B 21/443

FOREIGN PATENT DOCUMENTS

GB 656371 A 8/1951
GB 2445211 A * 7/2008 ..... A47L 9/1641
KR 200437729 Y1 12/2007
KR 101460676 B1 11/2014
WO WO 2019141482 A1 7/2019

* cited by examiner

2110

2108

RAZOR ASSEMBLY

CROSS-REFERENCE TO RELATED APPLICATIONS

This application is a continuation of U.S. patent application Ser. No. 15/982,825, filed May 17, 2018, which is continuation-in-part of U.S. patent application Ser. No. 15/098,349, filed Apr. 14, 2016, which claims priority to U.S. Provisional Patent Application No. 62/148,165, filed Apr. 15, 2015. All of the aforementioned patent applications are incorporated by reference herein in their entireties.

BACKGROUND

Conventionally, razors and razor assemblies, whether manual or electric are typically designed to provide a sharp clean look. For example, most of the razor advertising emphasize the smooth shave look after shaving. However, current changing trend amongst males is for keeping some facial hair. The workplace has gone from being a place requiring a cleanly shaven face to accepting some stubble, a 5 o'clock shadow or a beard.

SUMMARY

One or more implementation disclosed herein provides razor assemblies that allow a user to have a less than smooth shave by changing the distance between razor blade(s) and a razor blade guard. The distance between the razor blade(s) and the guard may be increased or decreased using a movable knob mechanism, a rotatable dial mechanism, a movable razor assembly and housing mechanism, a rotatable threaded handle, one or more slider mechanisms, a rotating blade mechanism, etc.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following detailed description.

BRIEF DESCRIPTION OF THE DRAWINGS

The described technology is best understood from the following Detailed Description describing various implementations read in connection with the accompanying drawings.

DETAILED DESCRIPTION

Figure 1:
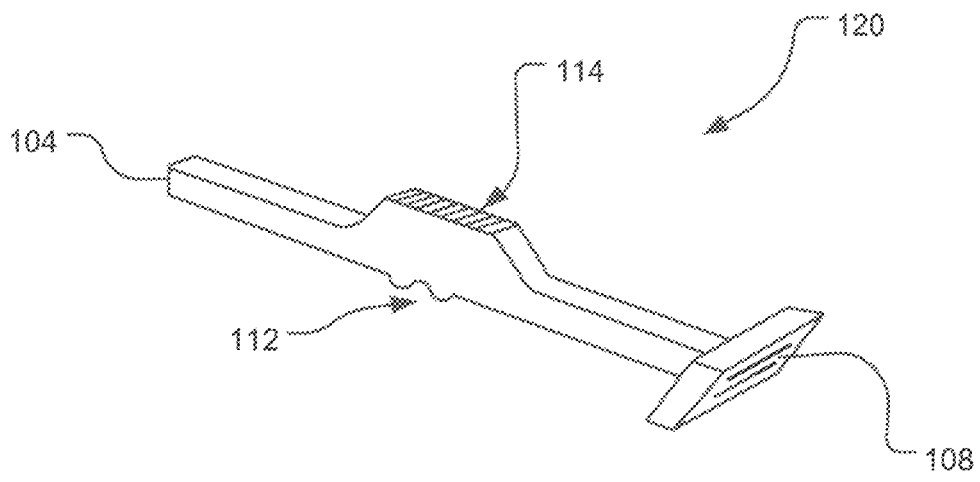
FIG. 1 illustrates a three-dimensional view of an example razor assembly that allows adjustable shaving depth.
Figure 1:
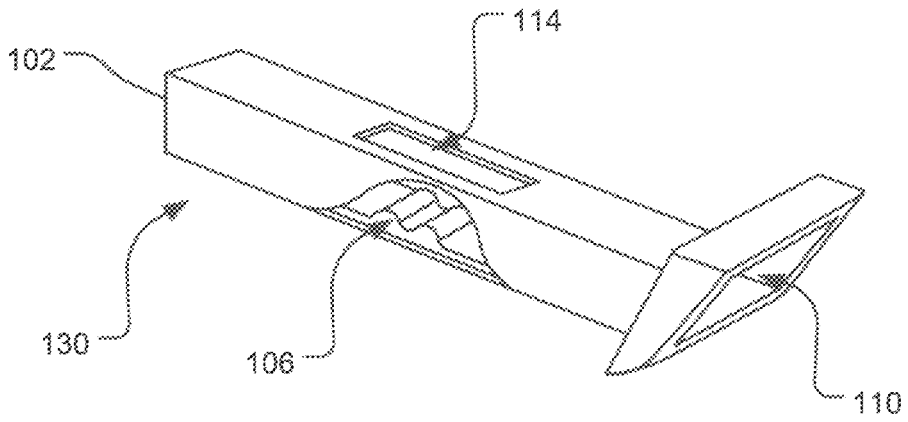

One or more implementations of a manual razor disclosed herein allow a user to shave with the intention of leaving some hair remaining on the part(s) shaved. The razor handle and/or razor blade itself can be designed to allow for space between the area of the body shaved and the razor blade, which would prevent a "clean" (removal of as much as the hair as possible) shave. While the various implementations disclosed here are discussed in view of shaving a user's face, they can also be used to shave other parts of the body, including but not limited to the head, genital areas, back, armpits, chest, and back.

Specifically, one or more implementations of the technology disclosed herein allows for a manual razor to allow a male to shave with a manual razor with the intention of keeping his facial hair to a predetermined length rather than completely removing all of it as all current manual razors offer. This can be done through a razor blade that is set back far enough from the user's face, to prevent a removal of all the hair. There are other ways besides setting the blade back. One such way is to put a razor cover on top of a current blade. The disclosed implementations allow for a replaceable or non-replaceable razor blade cartridge that is configured to allow for a shave that purposely leaves hair remaining. The depth of the razor blade can be altered providing for various lengths of hair remaining. In fact, one razor blade cartridge can be constructed so that it can be moved forward or back, thereby decreasing or increasing respectively the distance between the user's face and blade, allowing for a completely clean shave or shave that keeps a beard remaining, acting similar to a beard trimmer. The shaver can choose the amount of hair he wants to remain after a shaving by adjusting the dial, or, for example, by choosing a non-adjustable guard that is set at a specified distance from the razor blade.

The design shown in the picture has a piece of plastic, also called a guard (the present invention is not limited to plastic as any material can possibly be used) that provides the distance needed between the razor blade and the user's body, i.e., his face. The thickness of this plastic can be altered allowing for more or less hair to be shaven off. The shape of the plastic can just be around the top part of the blade, around the top and sides and/or around the whole blade. If the razor blade could be adjusted, this would be done through moving some part of the razor blade cartridge manually or some part of the razor blade handle (the part held by the user when shaving, that holds the razor blade cartridge).

The design of the present invention allows for use on 1, 2, 3, 4, 5, 6, 7 or more blades. The level of hair remaining can be greater than 0 mm by using this design. The pictures below show designs that allow for hair growth of 0.5 mm to 1 mm remaining. The disclosed implementations include all lengths of hair growth remaining, not being limited to the designs shown in the pictures. The present invention is not limited to replaceable razors. It could be used with disposable (meant for a 1 time use) razors. Another option to create the desired effect is to have a razor blade that is dull, preventing it from removing all the hair.

FIG. 1 illustrates a three-dimensional view of an example razor system 100 that allows adjustable shaving depth. Specifically, the razor system 100 includes a razor assembly 120 including a razor handle 104 attached to a razor blade 108, the razor handle having a first outer surface with a slider mechanism 112 and a second outer surface including a knob 114, the second outer surface being on the opposite side of the first outer surface.

A hollow razor housing 130 is configured to house the razor assembly 120, the razor housing including a groove 106 on one internal surface configured to be in proximity to the slider mechanism 112 of the razor assembly 120 such that the razor assembly 120 can be slidably moved along length of the razor housing 130 (or vice versa, 130 slidably moved along assembly 120) to change the distance between the razor blade 108 and an outer face opening 110 of the razor housing 130. The razor housing further includes an opening 114 on an outer surface to allow the knob 114 to protrude from the razor housing 130.

Figure 2:
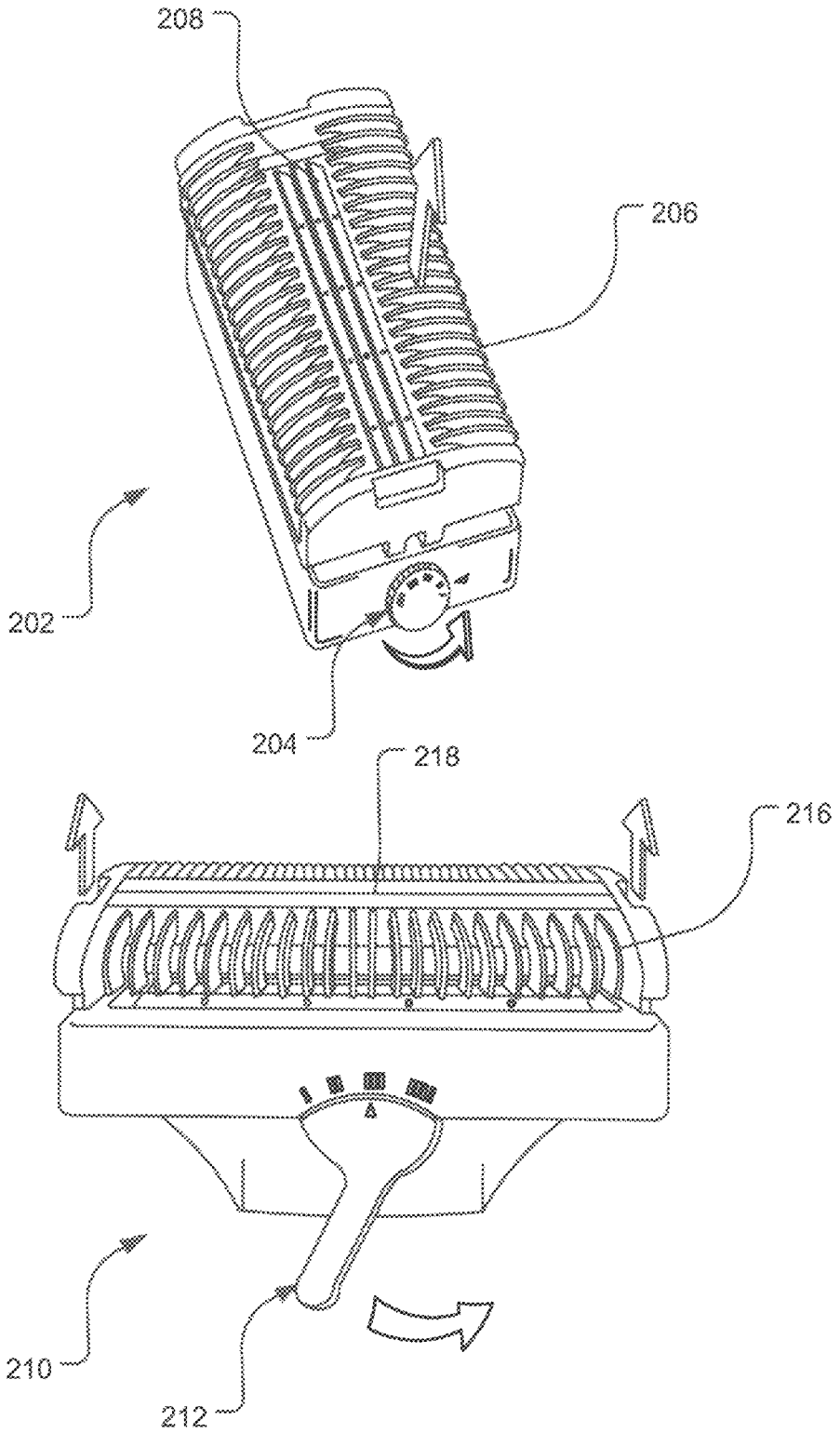
FIG. 2 illustrates three-dimensional views of example razor heads that allows adjustable shaving depth.

FIG. 2 illustrates three-dimensional views of example razor heads 200 that allows adjustable shaving depth. Specifically, a razor head 202 provides for a dial 204 that can be used to adjust space between blades 208 and guard 206. For example, a user can turn the dial 204 to increase or decrease the vertical space between the blades 208 and the top surface of the guard 206. The top surface of the guard 206 comes in face with a user using the razor head 202. Thus, if the vertical space between the blades 208 and the top surface of the guard 206 is lower, it results in a smoother shave. The higher this space, the rougher is the resulting shave (more hair remaining).

An alternative implementation of a razor head 210 provides a knob 212 that can be used to adjust the space between blades (not shown) and guard 216. For example, a user can turn the knob 212 to increase or decrease the vertical space between the blades and a top surface 218 of the guard 216. The top surface 218 of the guard 216 comes in face with a user using the razor head 210. Thus, if the vertical space between the blades and the top surface 218 of the guard 216 is lower, it results in a smoother shave. The higher this space, the rougher is the resulting shave (more hair remaining).

Figure 3:
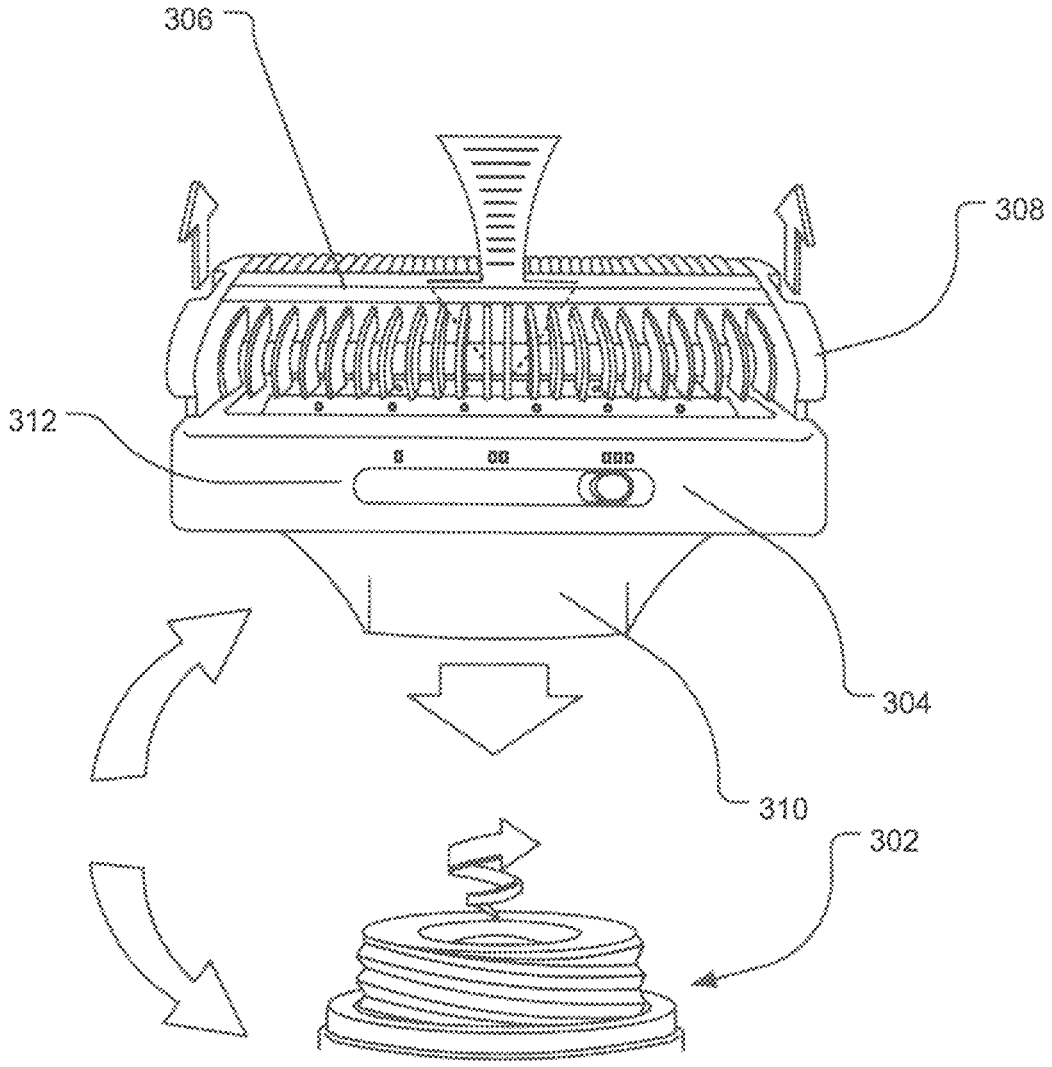
FIG. 3 illustrates an alternative three-dimensional view of another example razor head that allows adjustable shaving depth.

FIG. 3 illustrates an alternative three-dimensional view of another example razor head 300 that allows adjustable shaving depth. Specifically, the razor head 300 is shown with a threaded end 302 of a razor handle and a razor head 304 including a receiving end 310 configured to receive the threaded end 302. The threaded end 302 can be rotated to adjust the position of a guard 308 with respect to blades (not shown). Specifically, the threaded end 302 can be rotated in or out of the receiving end 310 so that a vertical distance between the blades and a top surface 306 of the guard 308 changes. Such distance can be shown by a display 312, so that a user can see how a closer or rougher shave will result with the given position of the guard 308 with respect to the blades.

Figure 4:
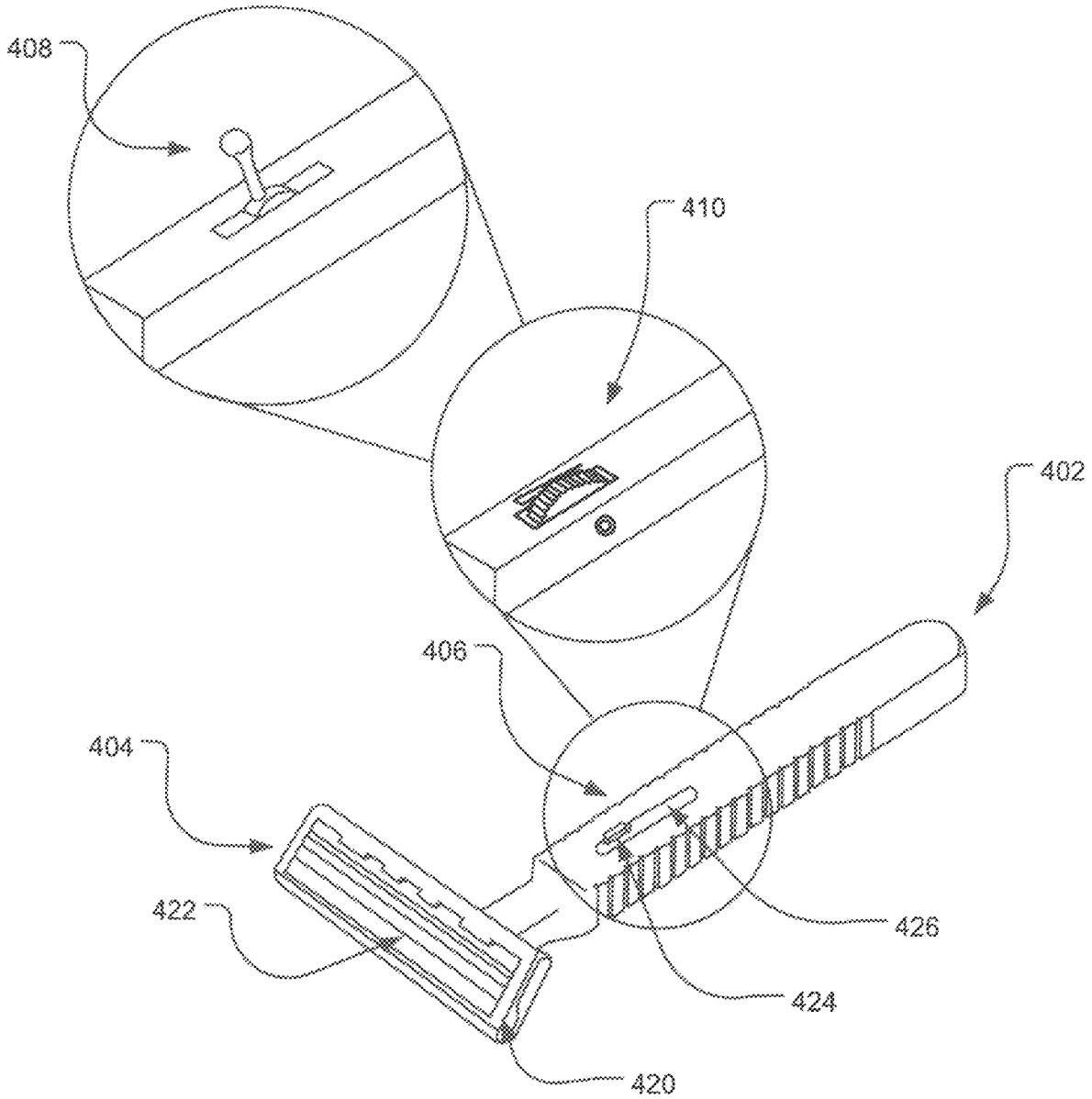
FIG. 4 illustrates a three-dimensional view of another example razor assembly.

FIG. 4 illustrates a three-dimensional view of another example razor assembly 400. The razor assembly includes a razor handle 402 and a razor head 404 including a guard 420 and blades 422. An adjustment mechanism 406 located on and inside the razor handle 402 can be used to adjust the distance between the blades 422 and the guard 420. In one implementation, such adjustment mechanism 406 is a sliding knob 424 that slides in a groove 416 along the length of the handle. The sliding knob 424 may be connected via a sliding structure (not shown) inside the handle and attached to the blades 422 so that the distance between the blades 422 and the face of the guard 420 can be adjusted to provide shaving to the user with different levels (smooth, stubble, 5 o'clock shadow, beard, etc.). In alternative implementations, a sliding wheel 410 or a sliding handle 408 may be used to control the position of the blades 422 with respect to the front face of the guard 420.

Figure 5:
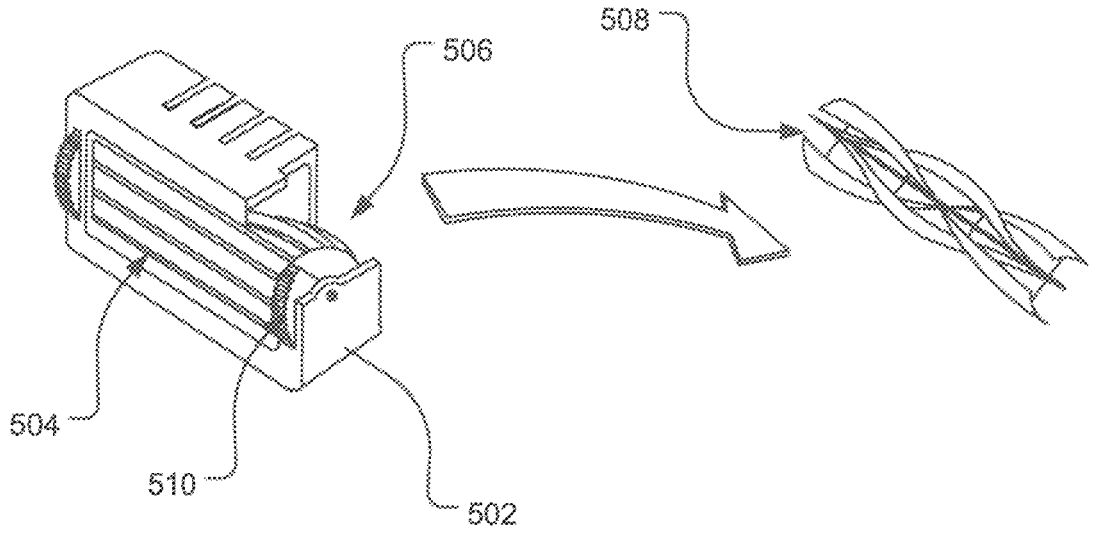
FIG. 5 illustrates a three-dimensional view of an example razor head mechanism including rotating blades which are rotated when the wheels on the sides are moved.

FIG. 5 illustrates a three-dimensional view of an example razor head mechanism 500 including rotating blades 506 (which are also shown separately as 508). The rotating blades 506 are attached to spinning wheels 510. The spinning wheels 510, when moved by sliding on face or body part of a user, cause the rotating blade 506 to spin and cause shave. The rotating blades are located in a guard 502 having a guard face 504 having slotted openings. One or more of the mechanisms for moving a guard in comparison to blades can be used to adjust the distance between the rotating blades 506 and the guard face 504 so as to change the level of shaving provided to the user. The spinning wheels 510 may be configured to move away from the guard face 504 to increase the distance between the rotating blades 506 and the guard face 504.

Figure 6:
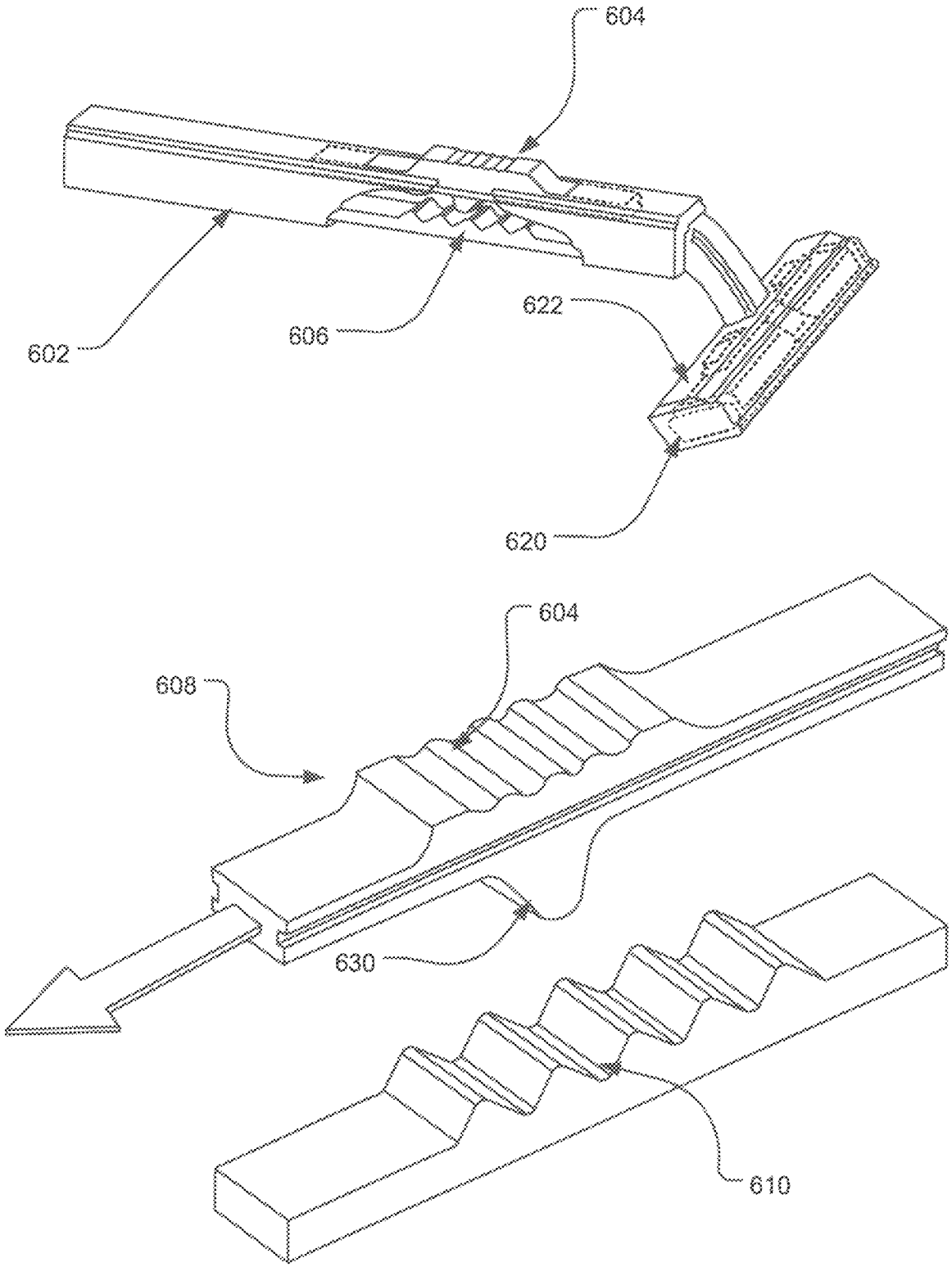
FIG. 6 illustrates a three-dimensional view of an alternative example razor assembly that allows adjustable shaving depth.

FIG. 6 illustrates a three-dimensional view of an alternative example razor assembly 600 that allows adjustable shaving depth. Specifically, the razor assembly 600 is illustrated to include a partially hollow housing 602 within which a razor arm and blade assembly can move. The razor arm and blade assembly may include a head 620 (shown with dotted lines) with blades (not shown) that move with respect to the guard 622, which is attached to the hollow housing 602.

A slider knob 604 that is attached to the razor arm and blade assembly can be used by a user to change the distance or space between the guard 622 and the blades. The razor arm also has a slider 630 that slides along grooves 610 along a lower inner surface of the housing 602 to provide variable positions for razor arm within the housing and thus variable distances between the blades and the guard 622.

Figure 7:
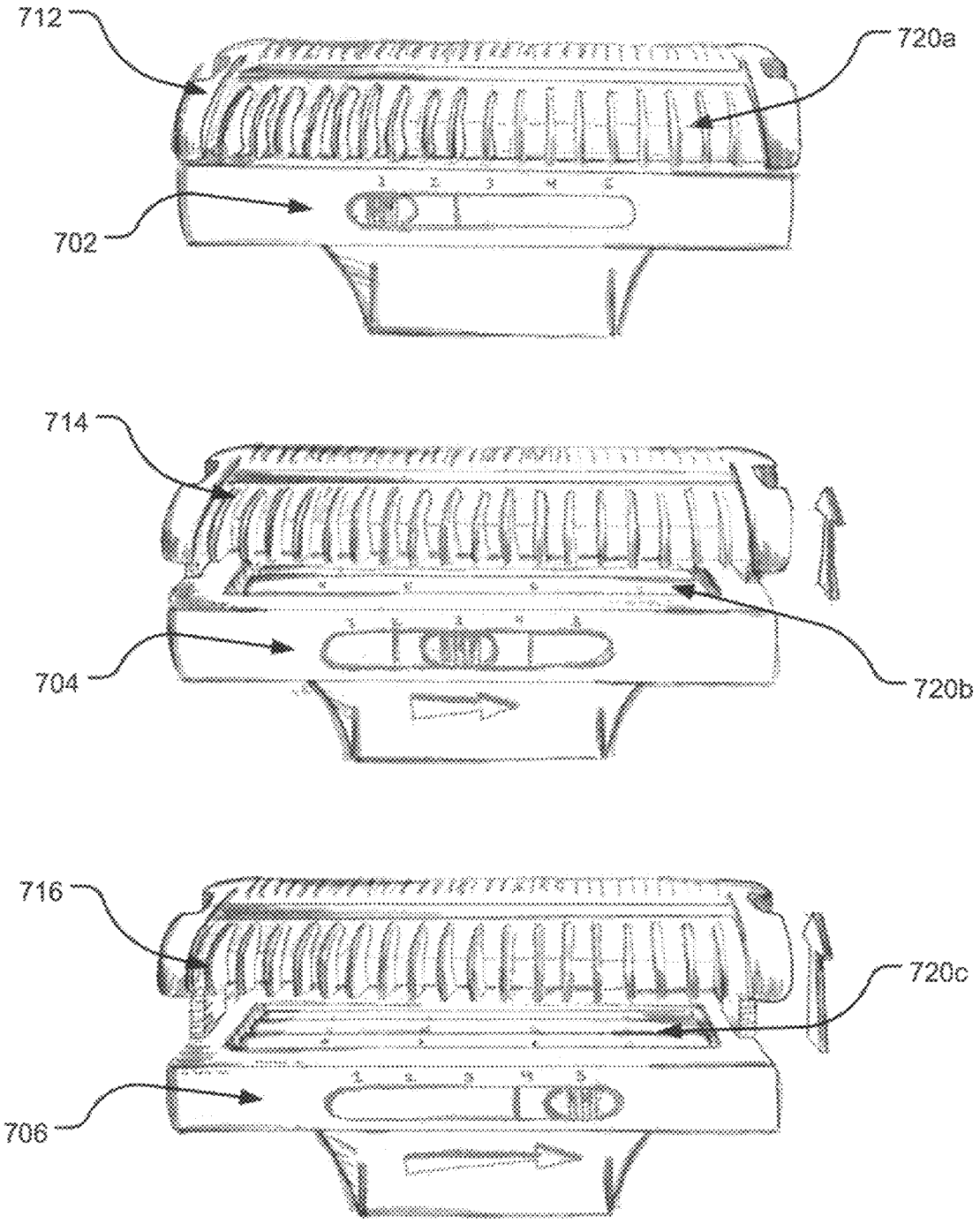
FIG. 7 illustrates three-dimensional views of alternative example razor heads that allows adjustable shaving depth.

FIG. 7 illustrates three-dimensional views of alternative example razor heads 700 that allows adjustable shaving depth. Specifically, the razor heads 700 are illustrated with a position of a knob at three different locations and based on the position of the knob, changing a space or distance between guard and blades. Specifically, at the knob position 702 the guard 712 is positioned such that the blade 720*a* is very close to the guard. In this implementation, the user gets a considerably close shave. At the knob position 704, the guard 714 is shown to have moved up—away from the blade 720*b*, resulting in increased space between the blade 720*b* and the guard 714, which results in a rougher shave for a user (a minimal amount of hair remains). Finally, at the know position 706, the guard 716 is shown to have moved further up—substantially away from the blade 720*c*, resulting in substantially increased space between the blade 720*c* and the guard 716, which results in a considerably rougher shave for a user (even a greater amount of hair remains). Note that the knob can be moved to a higher or lesser number of positions to finely adjust the difference in shave length/stubble for the user. Furthermore, instead of having numbers providing distinct positions along the length, the knob may also be moved along in an analog manner.

Figure 8:
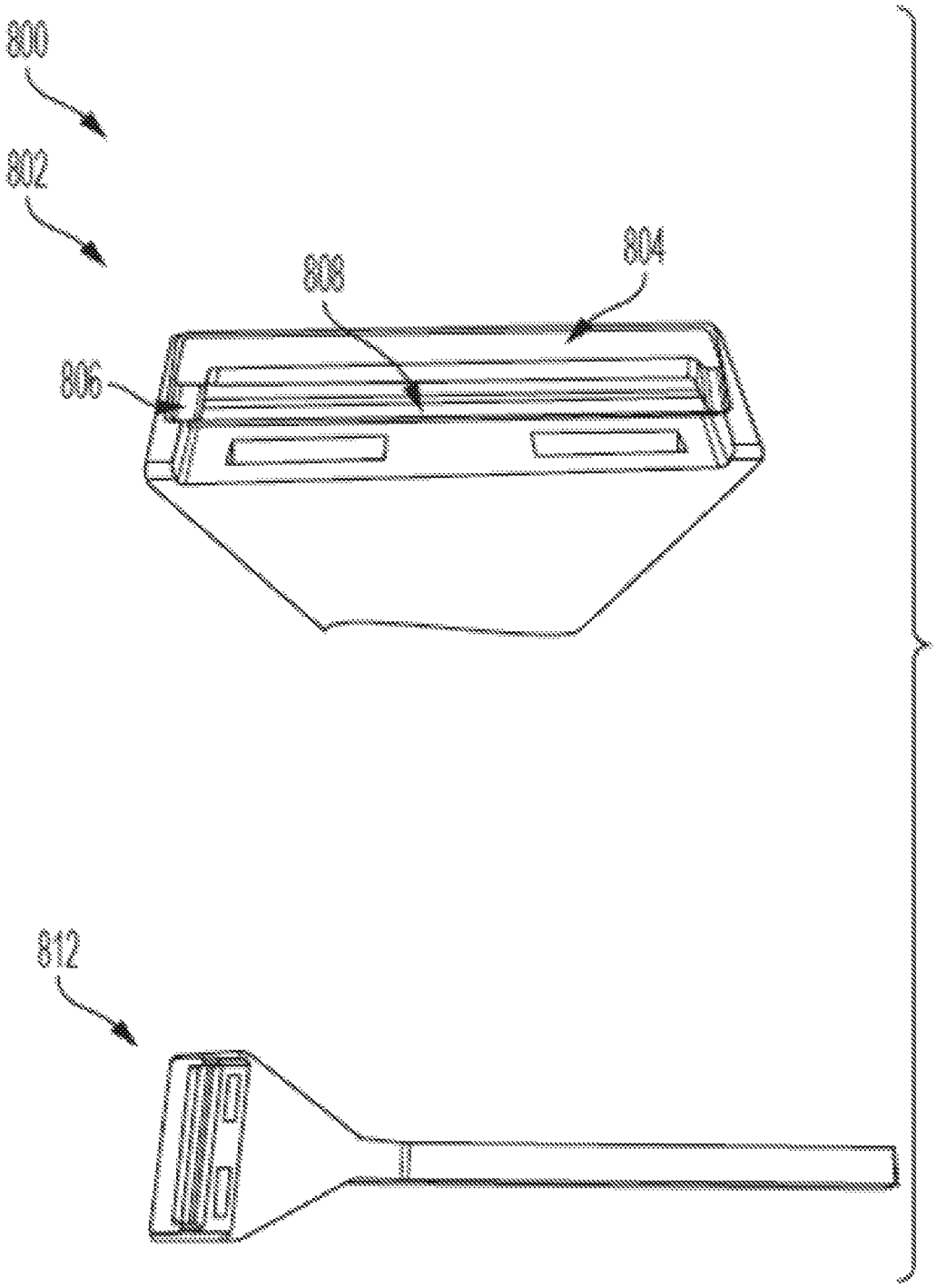
FIG. 8 illustrates three-dimensional views of an example three blade razor with top and side guards added for depth.

FIG. 8 illustrates three-dimensional views 800 of an example three blade razor with top 804 and side guards 806 added for depth between the guards 804 and 806 and blades 808. The view 812 illustrates an implementation with a handle.

Figure 9:
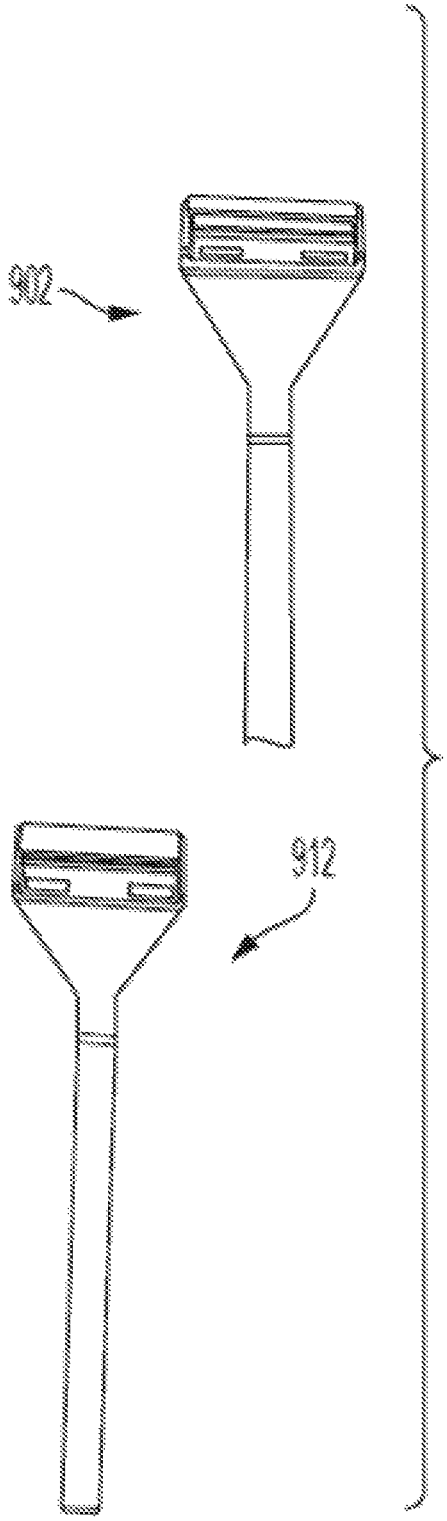
FIG. 9 illustrates a three blade razor with plastic guard overtop of razor blade only, which is thinner than other versions allowing for less hair remaining after a shave and a two blade razor with plastic guard over top of razor blade only, which is thinner than other versions allowing for less hair remaining after a shave.

FIG. 9 illustrates a three blade razor 902 with plastic guard overtop of razor blade only, which is thinner than other versions allowing for less hair remaining after a shave and a two blade razor 912 with plastic guard over top of razor blade only, which is thinner than other versions allowing for less hair remaining after a shave.

Figure 10:
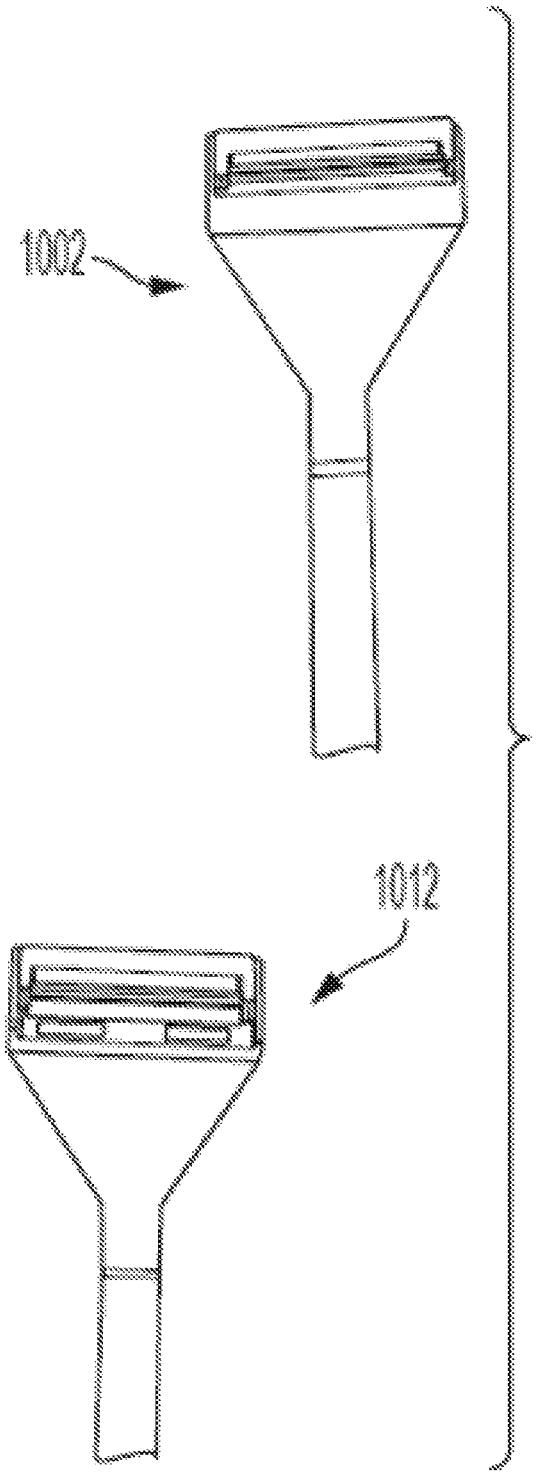
FIG. 10 illustrates a two blade razor with plastic guard over top and side of razor blade, which is thicker than other versions allowing for more hair remaining after a shave and a three blade razor with plastic guard over top and sides of razor blade, which is thicker than other versions allowing for more hair remaining after a shave.

FIG. 10 illustrates a two blade razor 1002 with plastic guard over top and side of razor blade, which is thicker than other versions allowing for more hair remaining after a shave and a three blade razor 1012 with plastic guard over top and sides of razor blade, which is thicker than other versions allowing for more hair remaining after a shave.

Figure 11:
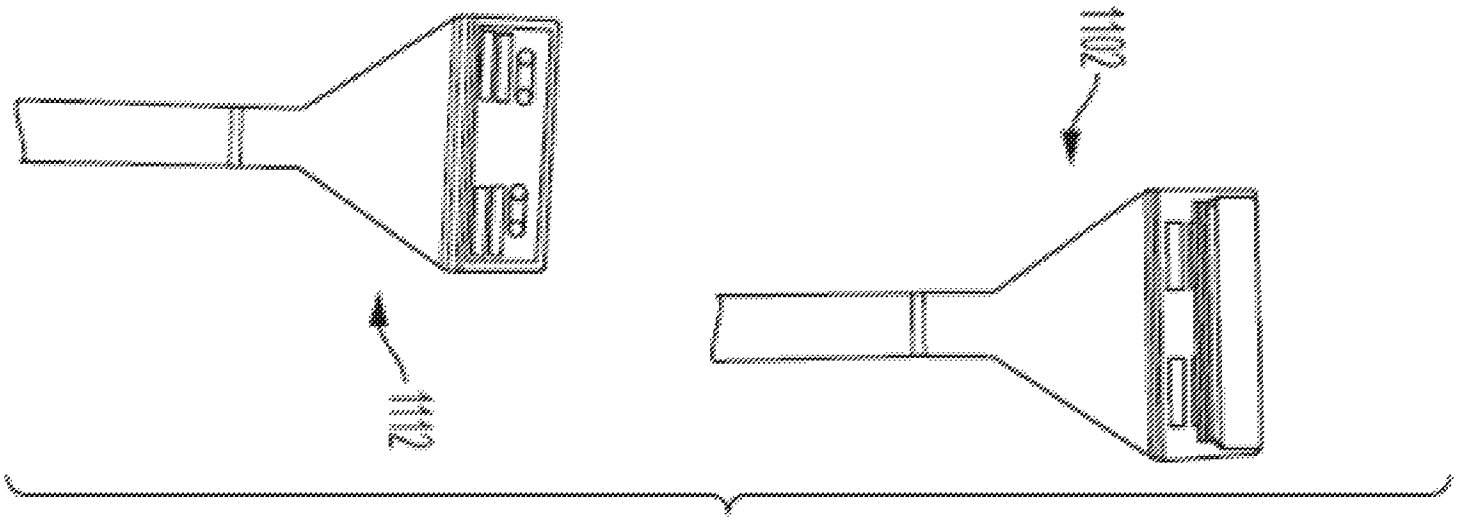
FIG. 11 illustrates a two blade razor with plastic guard over top of razor blade only, which is thicker than other versions allowing for more hair remaining after a shave and a razor assembly prototype without razor blade and guard being shown.

FIG. 11 illustrates a two blade razor 1102 with plastic guard over top of razor blade only, which is thicker than other versions allowing for more hair remaining after a shave and a razor assembly prototype 1112 without razor blade and guard being shown.

Figure 12:
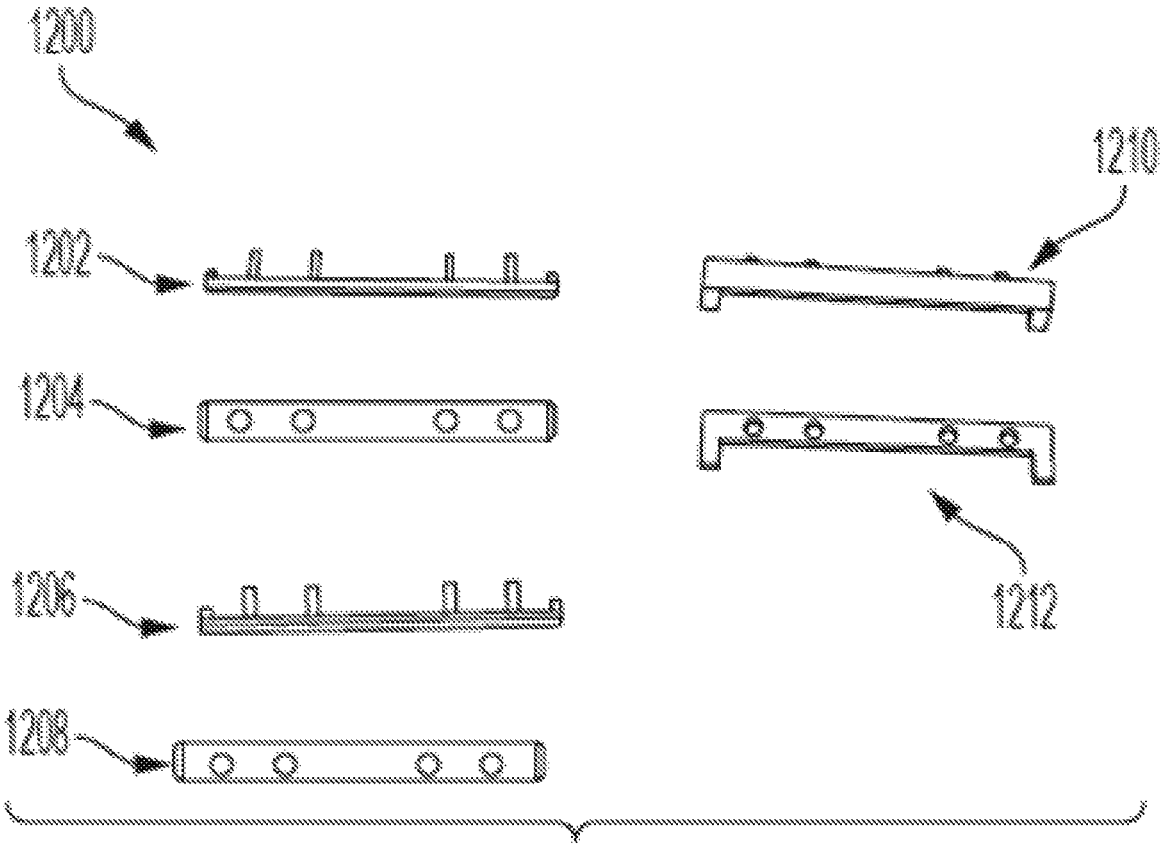
FIG. 12 illustrates various sized razor blade holders or guards of differing thickness and shape.

FIG. 12 illustrates various sized razor blade holders 1200 of differing thickness and shape. Specifically, FIG. 12 illustrates a razor blade holder 1202 that provides a guard for either the top or bottom only, with pegs that fit through the holes in the razor blade(s) and handle and pegs on the side that attach to the side of the razor cartridge. A razor blade holder 1204 that provides a guard for either the top or bottom of the razor blade with a thickness thinner than 1202. FIGS. 1202 and 1204 can be combined with one being used for the top guard and the other for the bottom guard. A razor blade holder 1206 that provides a guard similar to 1202 and 1204 but with a thickness greater than 1202. A razor blade holder 1208 that is wider than 1202, 1204 and 1206 that can act as a razor guard. A razor blade holder 1210 that provides a guard for either the top and two sides or the bottom and two sides, with pegs that fit through the holes in the razor blade(s) and secure into the handle. A razor blade holder 1212 that is similar to 1210 but thinner allowing for a closer shave.

Figure 13:
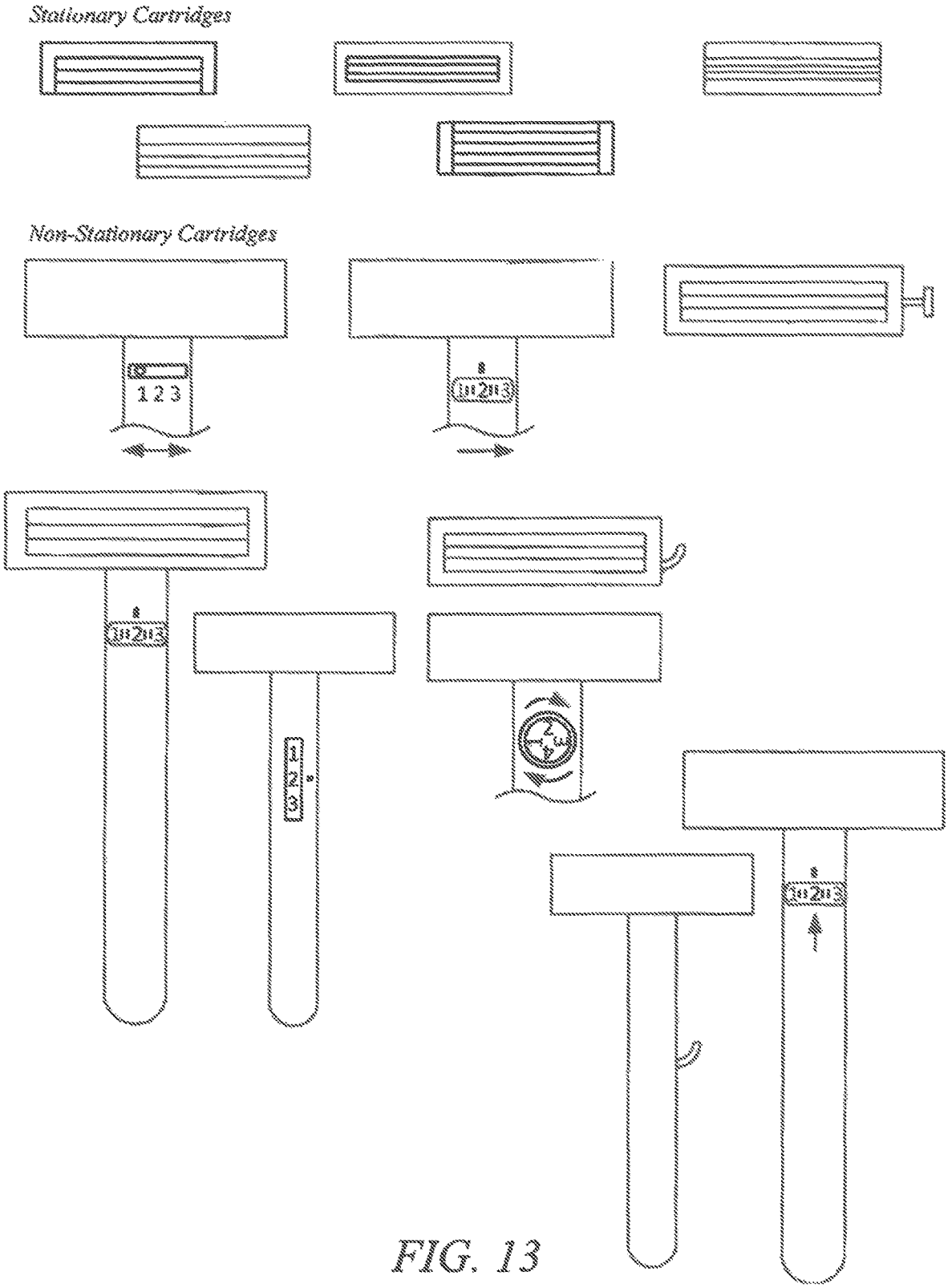
FIG. 13 illustrates various sketches illustrating framing a razor guard in various ways in stationary settings.
Figure 14D:
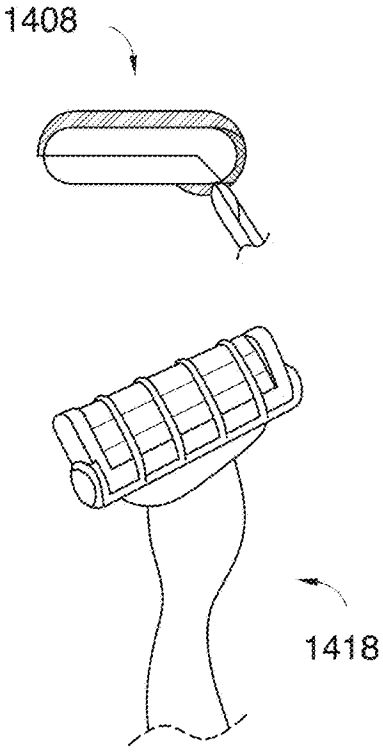
FIGS. 14A-14D illustrate example views of a razor assembly.
Figure 14C:
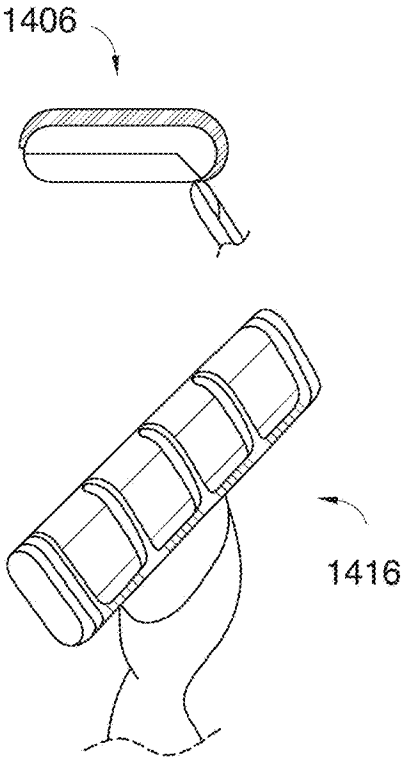
Figure 14B:
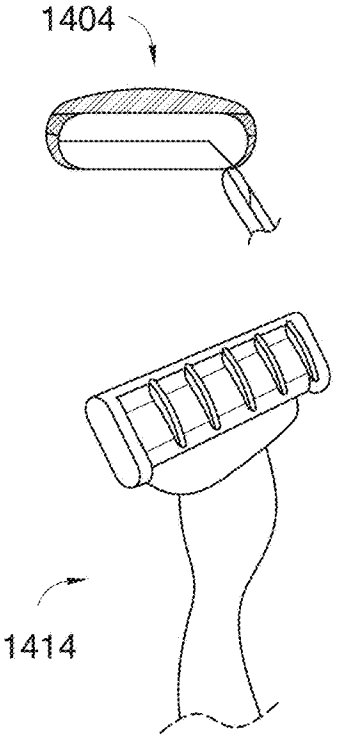
Figure 14A:
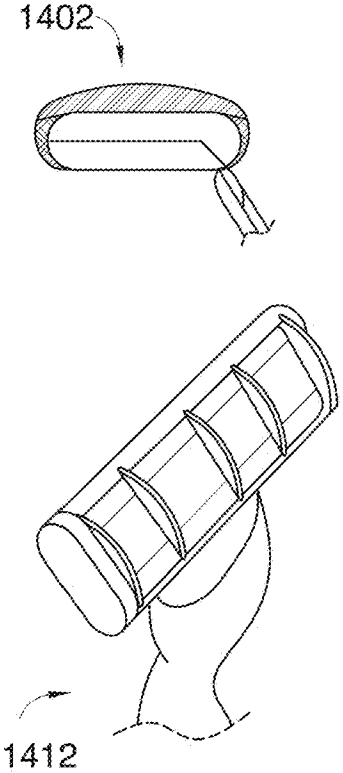

FIG. 13 illustrates various sketches 1300 illustrating framing a razor guard in various ways in stationary settings. For a stationary cartridge, the raised guard may be, although it doesn't have to be, permanent in its position. In other words, in one implementation, if the guard is raised by 0.5 mm, it is always raised by 0.5 mm. In an alternative implementation the razor cartridge could have a guard raised by another amount of distance, such as for example, 1 mm, 1.5 mm, etc. Here, the "raised guard" may refer to size of a spacer that separates the blade from the face of a user.

Specifically, the sketches 1-5 illustrate fixed guards:

#1. The raised guard is on 3 sides (not the bottom).

#2. The raised guard is on the top, above the blades only.

#3. The raised guard is on all 4 sides, surrounding the blades.

#4. The raised guard is only on the sides.

#5. The raised guards are on the top and bottom only, although in an alternative implementation, the guard can be on the bottom only.

The following sketches 6-8 disclose adjustable guards raise:

#6. On the back of the cartridge, a knob can be pushed left or right to increase or decrease the distance of the blades to the face.

#7. Same as #6 but with a dial.

#8. same as #6 but twist a device to make guard move back and forth.

The following sketches 9-14 illustrate razors where depth of the guard/spacer are controlled from a handle:

#9. A dial is used on the handle to control the depth of the guard/spacer.

#10. On the back of the handle, the depth can be controlled.

#11. A lever can be lifted up or pushed down to move the guard/spacer.

#12. On the back, a dial which shows how many days of hair growth you'd like to keep, i.e., 1 day, 3 days, 5 days.

#13. A lever is on the side of the handle, sticking out, allowing adjustment of the guard/spacer.

#14. A user can push a pin (for lack of better words) right and left going through the handle, that allows the guard/spacer to be adjusted.

Alternatively, razor assemblies may be provided where one or two blades whose sole purpose is to lift the hair while a following blade trims it. Furthermore, each of the razor assemblies disclosed herein where the space or distance between the blades and face is controlled by moving the guard/spacer, similar space or distance may also be achieved by keeping the guard/spacer stationary, but moving the blades away from the front end (that comes in touch with user's face/beard) of the guard so as to alter the distance between the blade and front end (that comes in touch with user's face/beard) of the guard.

FIGS. 14A-14D show various options for attached razor blade guards. The guards can be attached to the outside of the fixed blade (razor cartridge) to provide for a fixed distance between the shaver's face and the blades. These guards can be removed before or after use. There can be various sized guards allowing for different lengths of hair to remain after a shave, i.e., 0.5 mm, 0.9 mm or 1.3 mm. The guards could snap on to the razor cartridge, slide on, clip in or attach in other ways. Option A shows a full guard with a comb leading edge at the bottom. Option B shows the guard with reduced plastic and a reduced leading edge. Option C has a zero tracking edge, with a comb edge at the bottom of the guard. Option D has a zero tracking edge with reduced ends.

Referring to FIGS. 14A-14D, 1402 illustrates a sectional side view of a razor assembly with an integral 4-sided detachable guard placed over existing razor blade cartridge or razor blade. 1412 illustrates a three quarter view of a head of a razor with the guard attached covering all four sides of the razor frame. 1404 illustrates a sectional side view of a razor assembly that has a 3-sided detachable guard placed over the razor blade cartridge or razor blade. 1414 illustrates a three quarter view of a head of a razor with the guard attached covering three sides of the frame of the razor. 1406 illustrates a sectional side view of a head of a razor assembly that has a 3-sided detachable guard placed over the razor blade cartridge or razor blade with less height than 1402, allowing for the razor blade to be closer to the shaver's skin.

Furthermore, 1416 illustrates a three quarter view of a head of a razor with the guard attached covering 3 sides of the frame of the razor showing less height in the guard. 1408 illustrates a sectional side view of a head of a razor assembly that has a 3-sided detachable guard placed over the razor blade cartridge or razor blade with less thickness and height than 1402. 1418 illustrates a three quarter view of a head of a razor with the guard attached covering 3 sides of the frame of the razor showing both less height and thickness in the guard allowing for a closer shave.

Figure 15A:
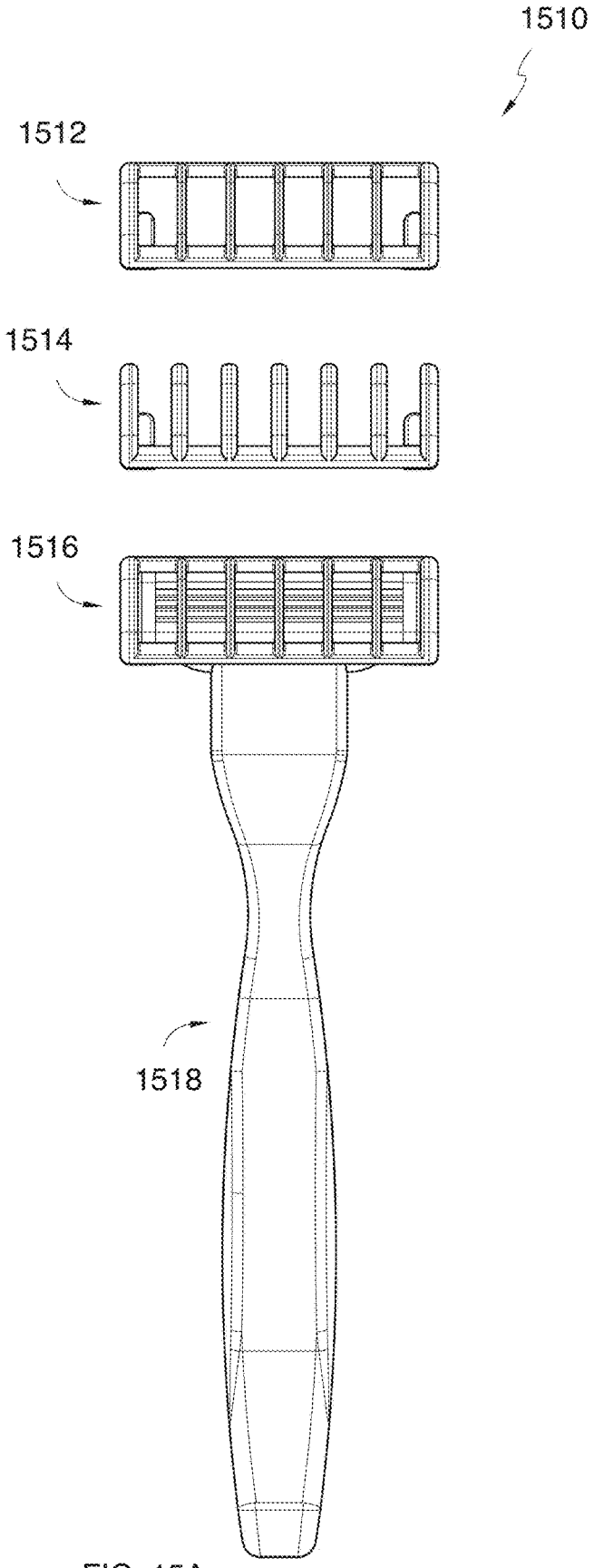
FIGS. 15A-15D illustrate other example views of a razor assembly.
Figure 15B:
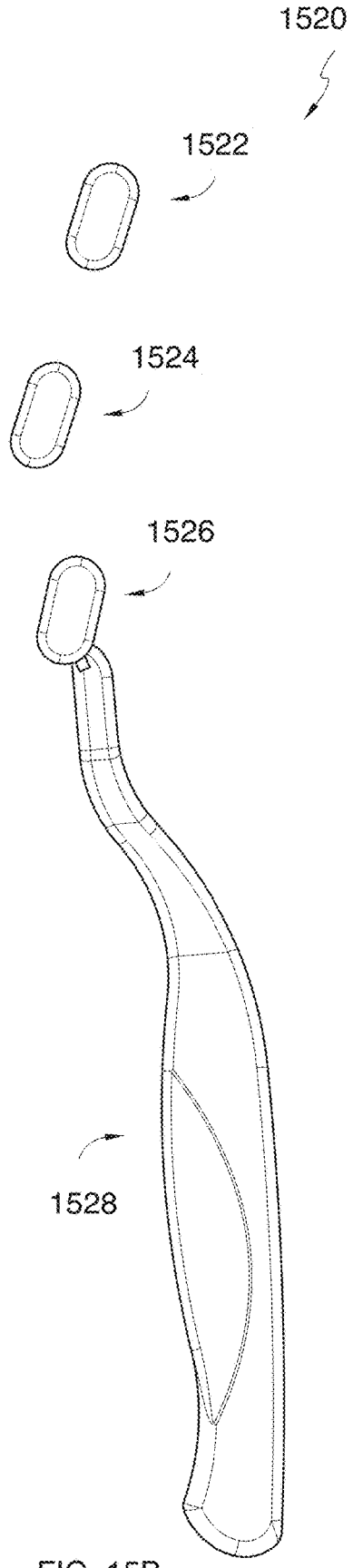
Figures 15C, 15D:
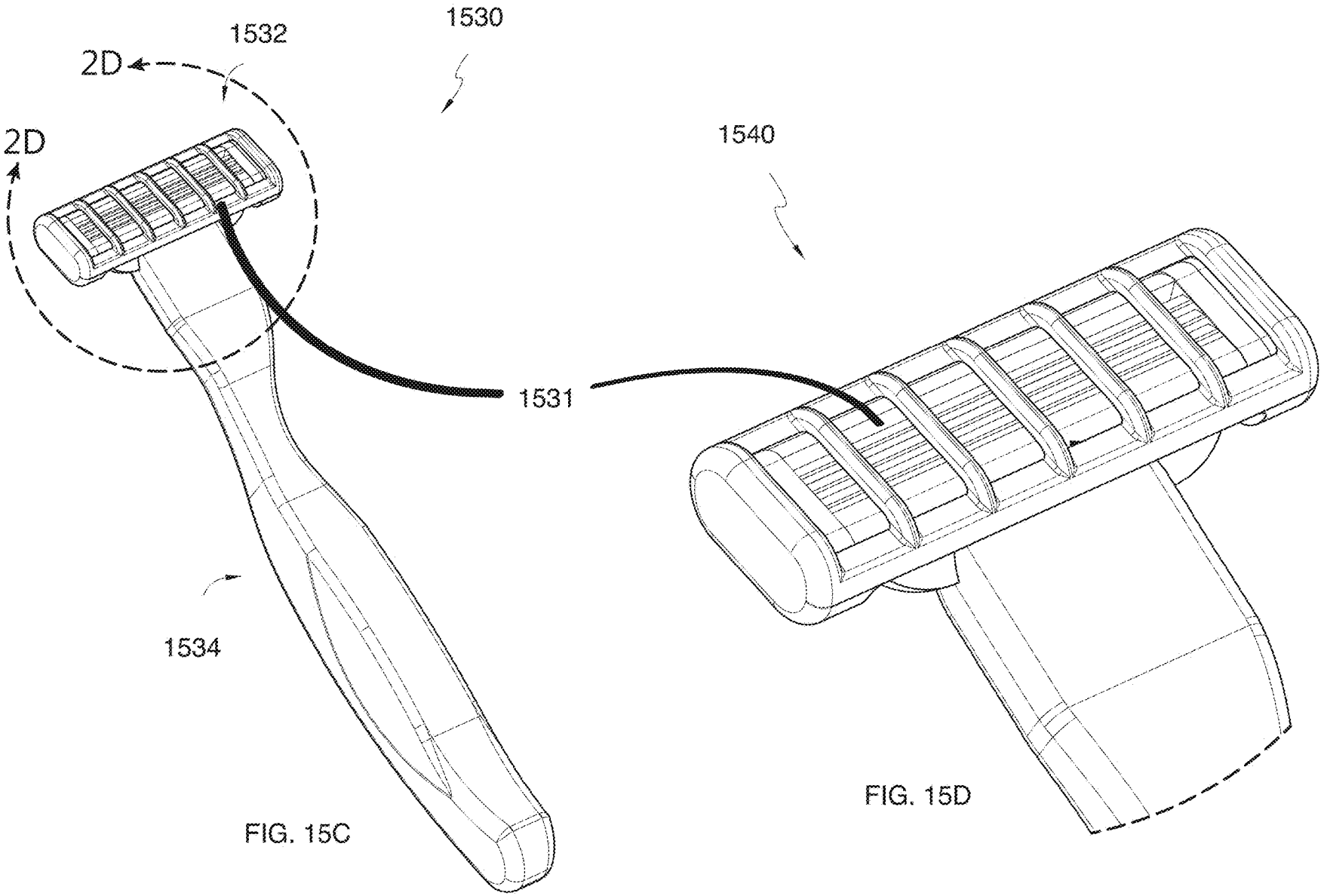

FIGS. 15A and 15B show a standard razor with the 5-OS ("5 o'clock shadow") blade attachment. The guards (which come in different shapes, thicknesses and/or heights) connect by (but not limited to) sliding on, snapping on or clicking into an existing razor cartridge. Blade Guard 1514 shows an opened trailing edge while Blade Guard 1512 shows a closed trailing edge. 1516 shows the 5-OS Blade Guard 1512 in position. These cartridges may or may not be permanently attached to a razor handle. The guards increase the distance between the razor blades and the user's skin, i.e., the face. These guards reduce the amount of hair being trimmed.

Referring to FIGS. 15A and 15B, 1510 shows top views of various iterations of detachable razor guards or caps that can fit on via various ways such as but not limited to snapping into, sliding over or clipping into a razor or razor blade cartridge that is attached to a handle (1518). 1512 illustrates a top view of a detachable razor guard or cap that covers all four sides of a razor blade cartridge or razor blade. 1514 illustrates a top view of a detachable razor guard or cap that covers 3 sides of a razor blade cartridge leaving one end of the vertical spacers without a border. 1516 illustrates 1512 being connected to the razor cartridge to handle 1518. The razor cartridge or blade(s) may or may not be permanently attached to handle 1518. 1520 illustrates the side views of the razor guards being attached to the razor blade cartridge. 1522 is the side view of guard or cap 1512. 1524 is the side view of guard or cap 1514. 1526 is the side view of guard or cap 1512 attached to the razor blade cartridge or razor which is attached (permanently or not permanently) to a handle 1528.

Specifically, 1528 illustrates the side view of the handle attached to the razor blade cartridge with the detachable guard covering the cartridge. 1530 illustrates a razor blade cartridge with a built-in guard or cap. 1532 illustrates a non-detachable guard on top of a razor blade cartridge. 1532 is permanently attached to razor blade cartridge. 1531 illustrates a standard razor blade cartridge which may or may not be permanently attached to razor handle 1534. 1534 illustrates a side and top view of razor handle which has a razor blade cartridge 1531 with a permanently affixed guard 1532. 1540 illustrates a close-up view of the permanently affixed guard or cap that covers the razor blade cartridge.

Figure 16B:
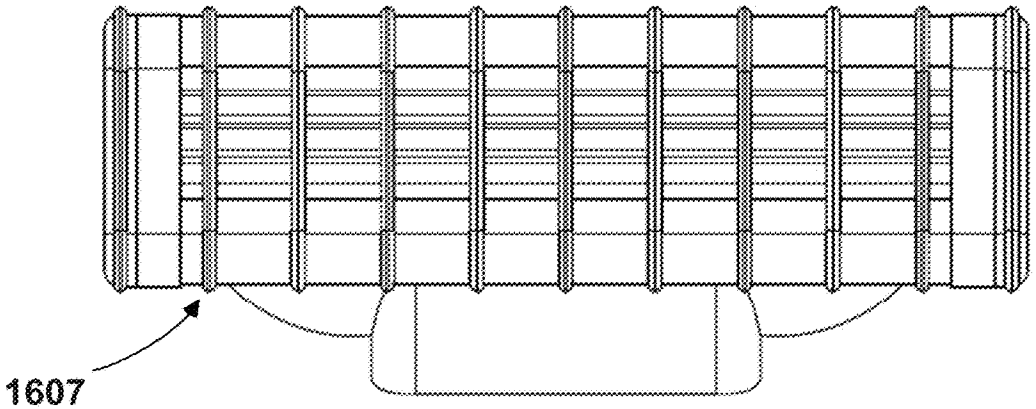
FIGS. 16A-16D illustrate alternative example views of a razor assembly.
Figure 16A:
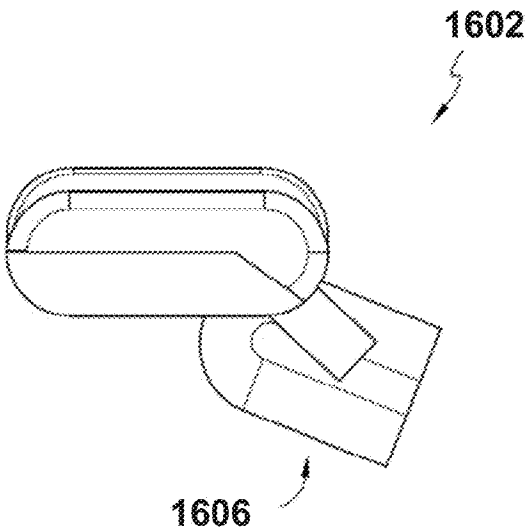
Figure 16C:
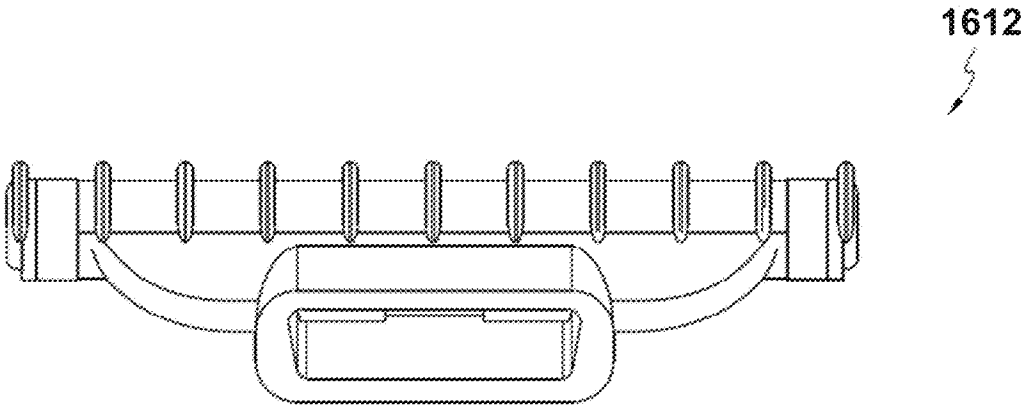
Figure 16D:
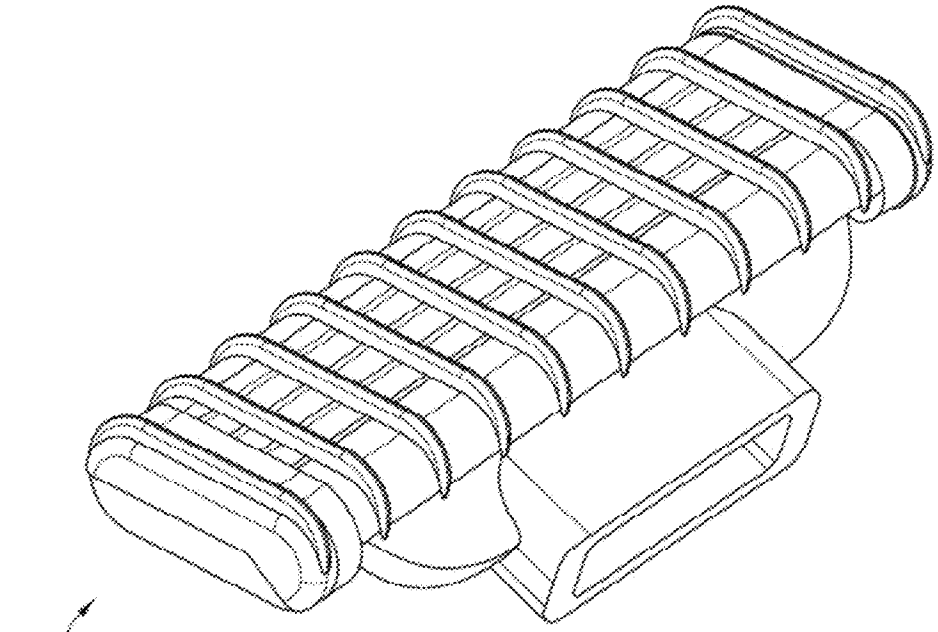

FIGS. 16A and 16B show a modified 5 o'clock shadow stock blade cartridge. Any razor cartridge, not limited to a particular brand, can be modified with a built-in razor guard. The built in razor guards, which are permanently attached to the razor cartridge can come in various sizes and or heights, allowing for the desired amount of hair to remain after a shave, i.e., 0.5 mm, 0.9 mm or 1.3 mm.

Referring to FIGS. 16A and 16B, 1602 illustrates a side view of the razor blade cartridge with guard or cap permanently affixed. 1606 illustrates the bottom of the razor blade cartridge which allows it to be connected to a razor blade handle 234. 1610 illustrates the top view of the razor blade cartridge with guard of cap permanently attached and displaying the connector 1607. 1612 illustrates the bottom view of the razor blade cartridge with guard of cap permanently attached showing the empty cavity of the connector which connects with the razor handle. Various sized guards or caps (which are connected to the razor blade cartridges) can be interchangeable with the same razor handle. For example, one assembly may allow for 0.5 mm of hair to remain after a shave, while another assembly may be swapped out for the previous and allow for 0.9 mm of hair to remain after a shave. 1614 illustrates a top and side view of a razor blade cartridge with a permanently affixed guard or cap.

Figure 17:
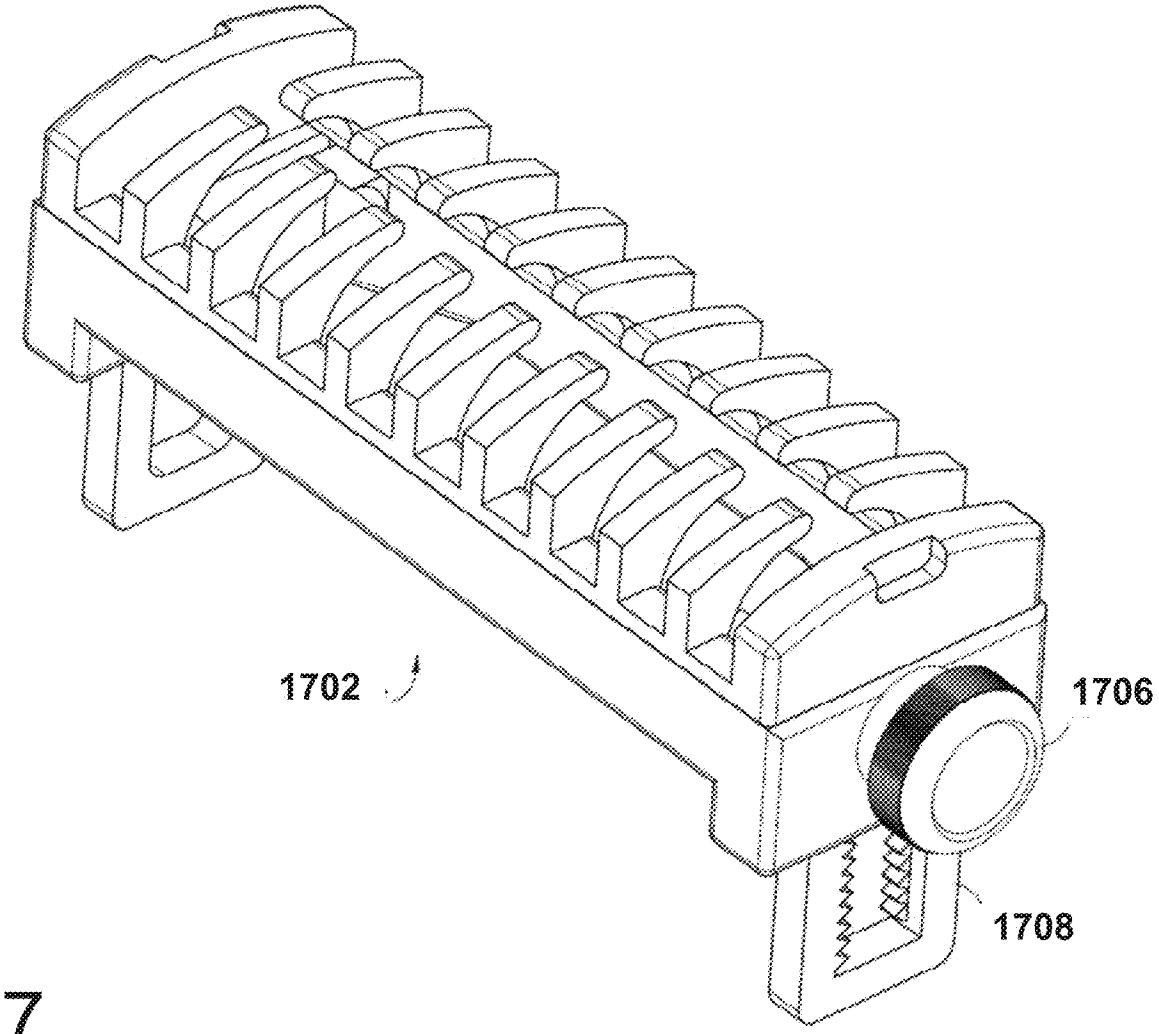
FIG. 17 illustrates example adjustable razor blade guard.
Figure 18D:
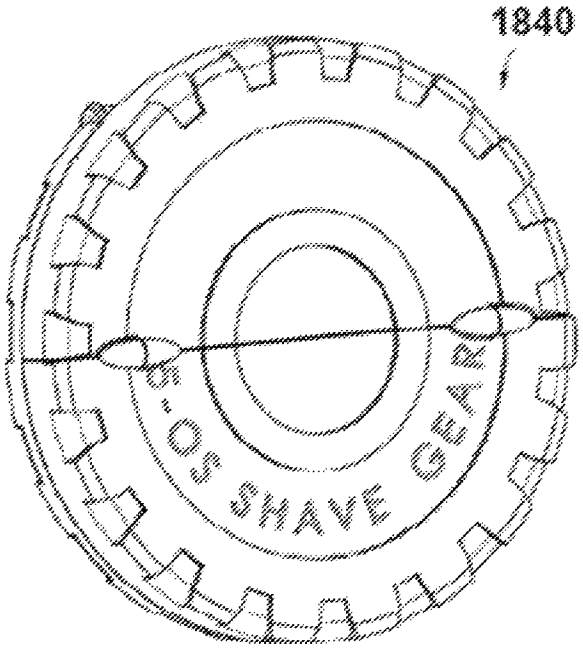
FIGS. 18A-18D illustrate various views of a gear shaped shave handle.
Figure 18C:
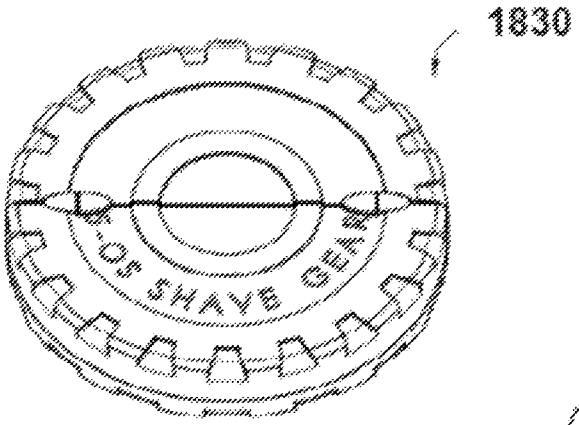
Figure 18B:
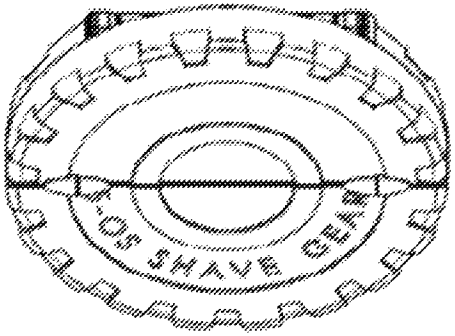
Figure 18A:
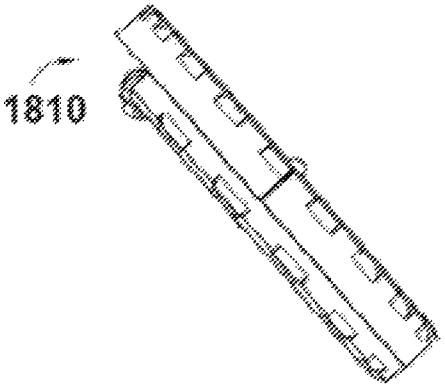
Figure 19B:
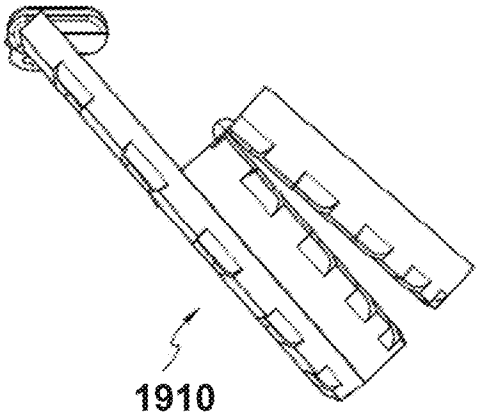
FIGS. 19A-19E illustrate various views of a razor blade cartridge gear shaped shave handle.
Figure 19C:
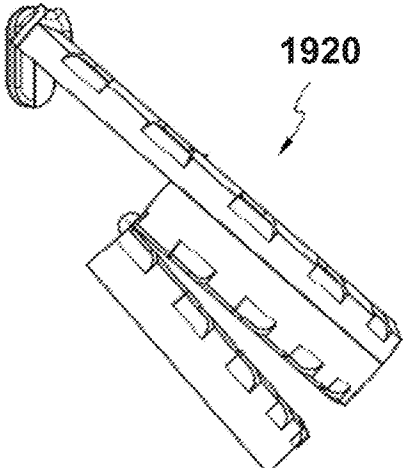
Figure 19A:
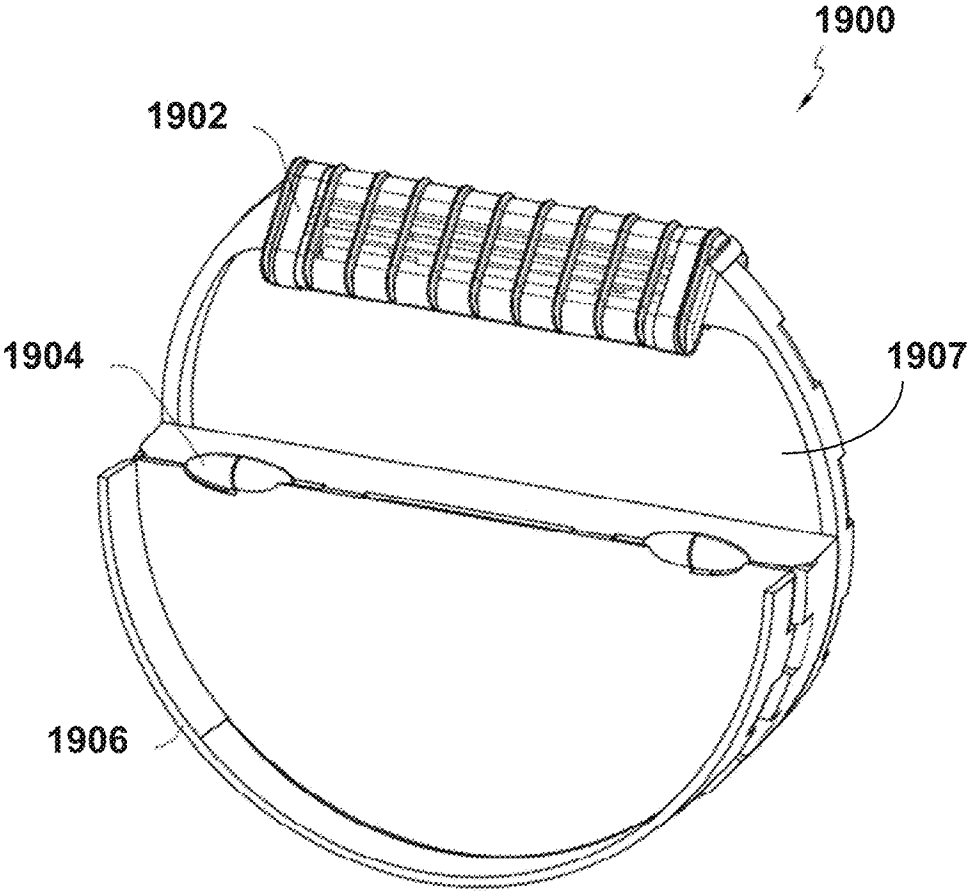
Figure 19E:
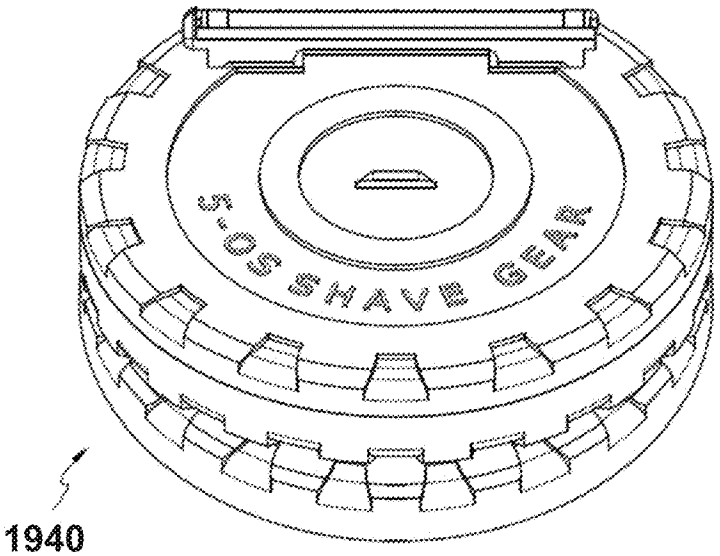
Figure 19D:
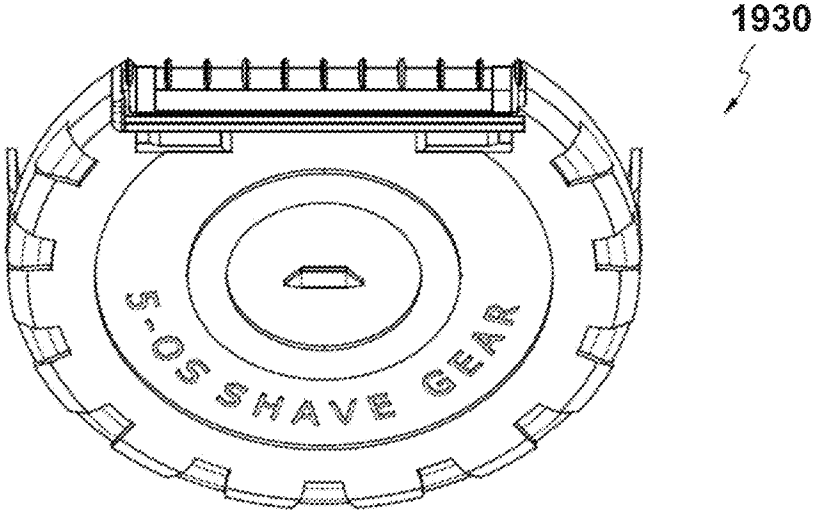

FIG. 17 shows that razor blade guard can be attachable or permanently adhered to a razor cartridge and/or handle. The guard is adjustable allowing the user to change the desired length of hair to remain. The guard moves up and down based on a twist of a dial. For example, twisting it to the right could make the guard move up (allowing for more hair to remain during a shave) and twisting it to the left could make the guard move down (allowing for less hair to remain after a shave). As the guard moves up, there is a greater distance between the razor blade and the hair, reducing the length of hair being cut.

Referring to FIG. 17, 1702 illustrates an adjustable razor blade guard that is either permanently attached to a razor blade cartridge or can be taken on and off. 1706 illustrates a dial which causes the guard to move up and down, allowing for different lengths of hair to remain after a shave. 1708 illustrates the teeth that the guard moves back and forth on from the twisting of dial 1706.

FIGS. 18A-18D show the 5-OS Shave Gear non-adjustable razor in a closed state. In this closed position, the razor is safe to travel as the blade(s) are not exposed. This option may offer a pre-determined amount of hair remaining after a shave or it may be used as standard razor with the goal of a clean, smooth shave, removing as much hair as possible. The razor cartridge can be removed and replaced with a new cartridge with or without a built in guard. The guard built into the razor cartridge may be of a different height allowing for a different shave. The razor blades may also be pushed back lower into the cartridge to allow for the desired 5 o'clock shadow. The unique shape of this design allows for the user to place his/her thumb on one side and 1, 2, 3 or 4 fingers on the other side based on preference and/or finger size.

Referring to FIGS. 18A-18D, 1840 illustrates a three quarter view of gear shaped shave handle with 180-degree flip down cover in closed position. 1830 illustrates a three quarter underside view of gear shaped shave handle with 180-degree flip down cover in closed position. 1820 illustrates a three quarter topside view of gear shaped shave handle with 180-degree flip down cover in closed position. 1810 illustrates a side view of gear shaped shave handle with 180-degree flip down cover in closed position.

FIGS. 19A-19E show a shave gear non-adjustable razor in the open position. The outside casing or shell opens by being pulled down, exposing the razor cartridge. The razor cartridge and/or guard is non-adjustable, providing for one length of a shave. However, the cartridge could be removed and replaced with a different cartridge that allows for a different amount of hair to remain after a shave. Extra razor cartridges can be stored inside this design. The unique shape of this design allows for the user to place his/her thumb on one side and 1, 2, 3 or 4 fingers on the other side based on preference and/or finger size.

Referring to FIGS. 19A-19E, 1910 illustrates a left hand side view of closeable but not adjustable for the razor blade cartridge gear shaped shave handle with 180-degree flip down cover in open position to expose integral 11 tooth riser shaving cartridge. 1920 illustrates a right hand side view of closeable but not adjustable for the razor blade cartridge gear shaped shave handle with 180-degree flip down cover in open position to expose integral 11 tooth riser shaving cartridge. 1900 illustrates a three quarter view of closeable but not adjustable for the razor blade cartridge disc gear shaped shaver handle 180-degree flip down cover in open position to expose integral 11 tooth riser shaving cartridge. 1902 illustrates an integral to housing 11 tooth riser shaving cartridge. 1904 illustrates a 180-degree flip down cover hinge. 1906 illustrates a 180-degree flip down cover. 1907 illustrates a storage area for extra razor blade cartridges. 1940 illustrates a three quarter underside, back view of disc gear shaped shaver handle with 180-degree flip down cover in open position. 1930 illustrates a three quarter topside, back view of disc gear shaped shaver handle with 180-degree flip down cover in open position.

Figure 20B:
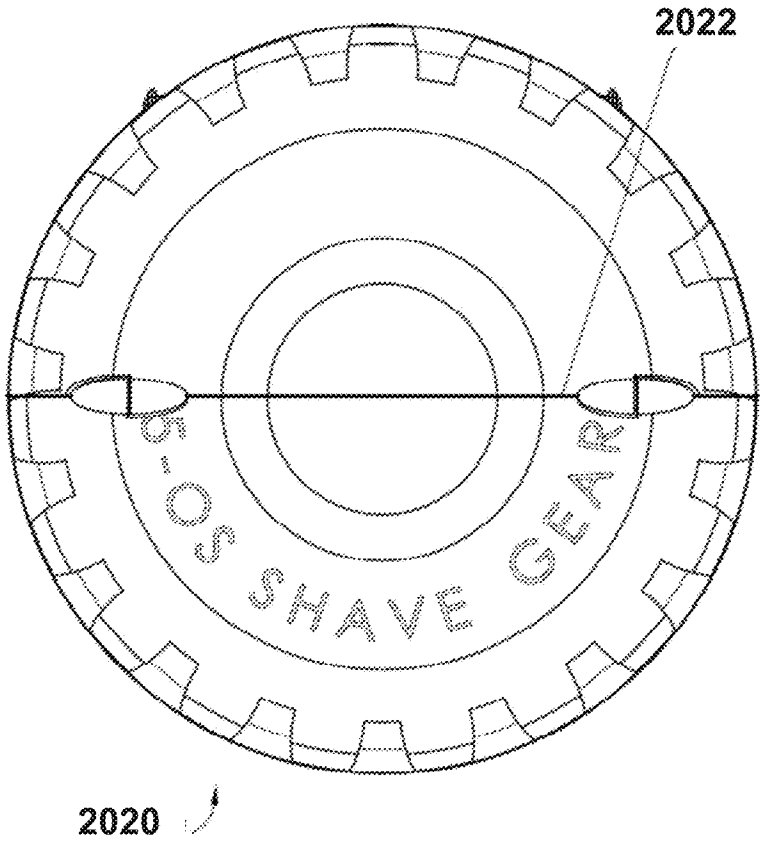
FIGS. 20A-20B illustrate various views of a disc gear shaped shaver.
Figure 20A:
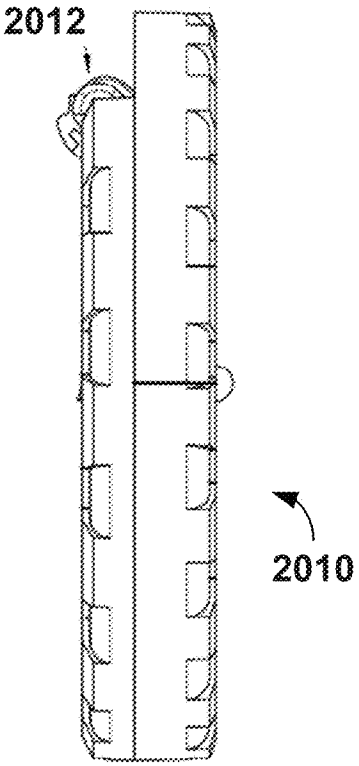
Figure 21B:
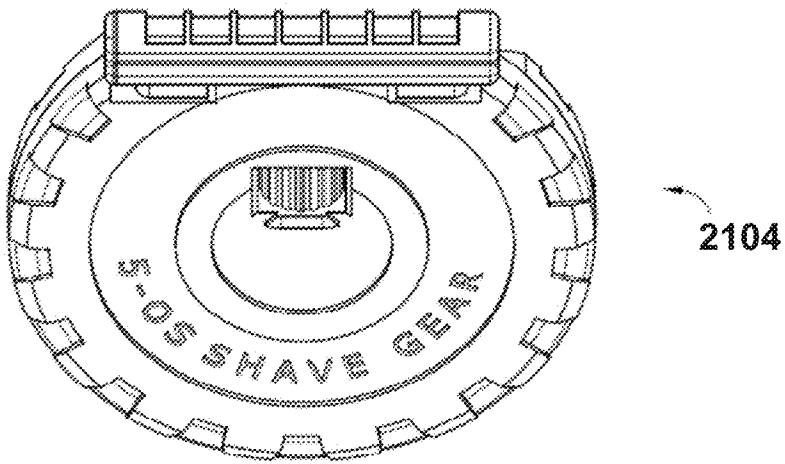
FIGS. 21A-21E illustrate various alternative views of the disc gear shaped shaver.
Figure 21C:
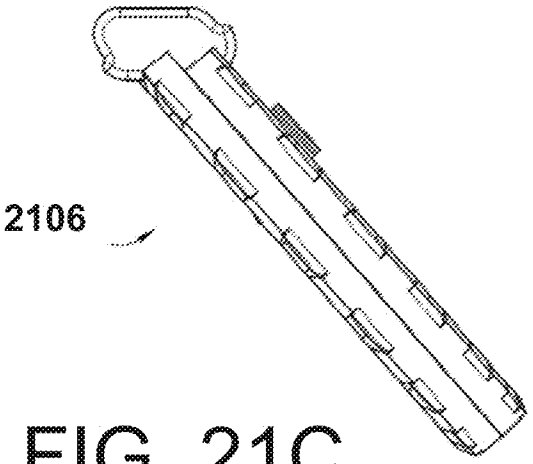
Figure 21A:
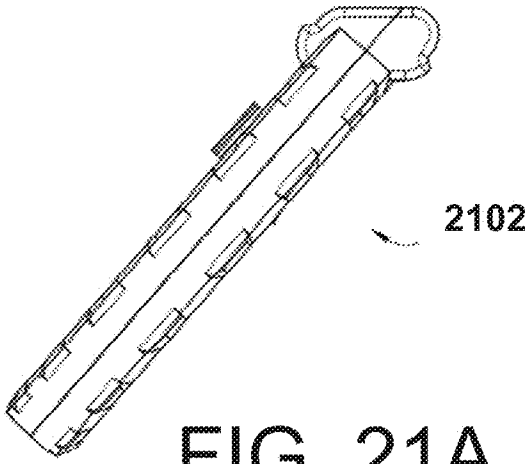
Figure 21E:
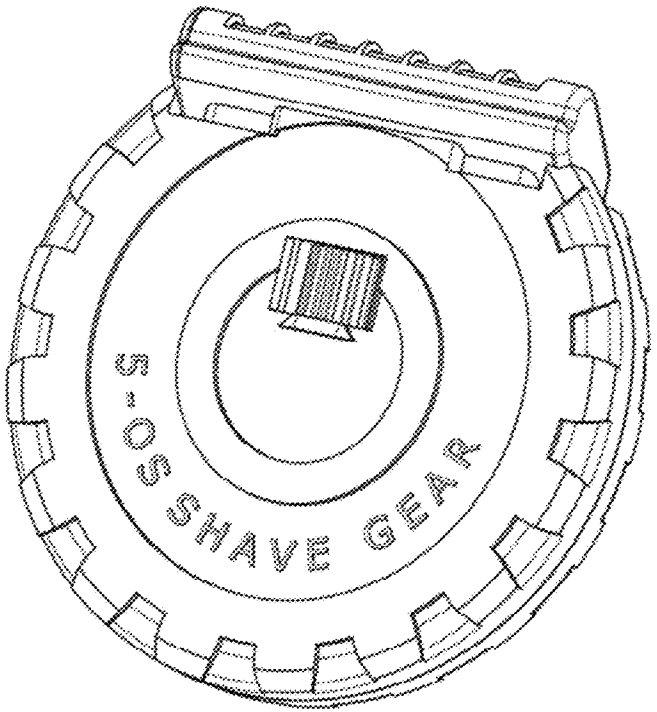
Figure 21D:
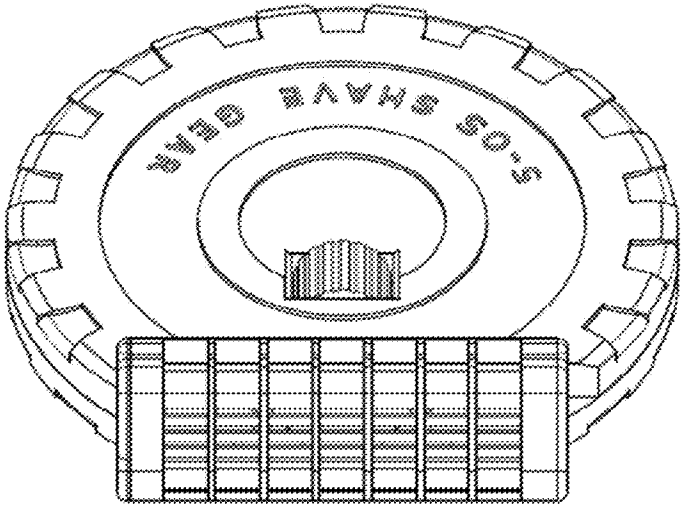

FIGS. 20A-20B show the Shave Gear non-adjustable razor in the closed state in plan views. One side flips up and down, exposing the razor(s), but the razor cartridge and/or guard are not adjustable. Referring to FIGS. 20A-20B, 2020 illustrates a front view of disc gear shaped shaver with blade cover closed. 2022 illustrates a Parting line between 180-degree flip down cover and disc gear shaped shaver handle. 2010 illustrates a left hand side view of disc gear shaped shaver with blade cover in closed position. 2012 illustrates an integral 11 tooth riser shaving cartridge shown covered in front by 180-degree flip down cover in closed position.

FIGS. 21A-21E show the Shave Gear adjustable razor. A user can turn the dial to move the razor blades in the cartridge up or down. The other option is that the dial can be used to move the guard up and down, while the razor blades in the cartridge remain stable. The razor cartridge can be removed when desired and replaced with another cartridge. This version does not allow for one or more sides of the "handle" (the part the shaver grips) to move. The only part that moves is the dial that adjusts the height of the guard or razor blades in the cartridge. The unique shape of this design allows for the user to place his/her thumb on one side and 1, 2, 3 or 4 fingers on the other side based on preference and/or finger size.

Referring to FIGS. 21A-21E, 2106 illustrates a left hand side view of height adjustable disc gear shaped razor. 2104 illustrates a rear three quarter top view of height adjustable disc shaped razor. 2102 illustrates a right hand side view of height adjustable disc gear razor. 2108 illustrates an alternative view. 2110 illustrates a three quarter rear view of height adjustable disc gear shaped razor.

Figure 22:
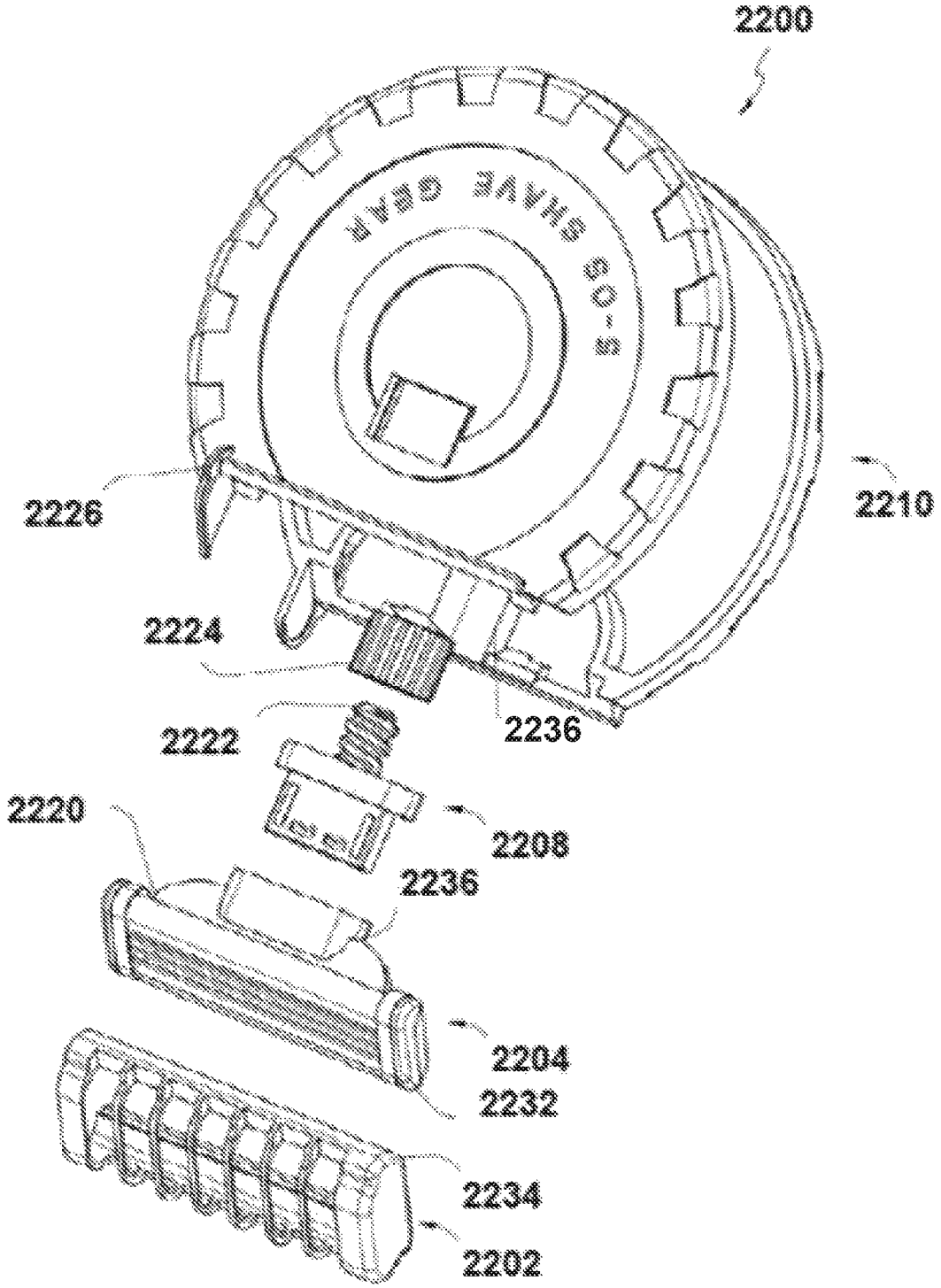
FIG. 22 illustrates a full view of detached shave gear model.
Figure 23C:
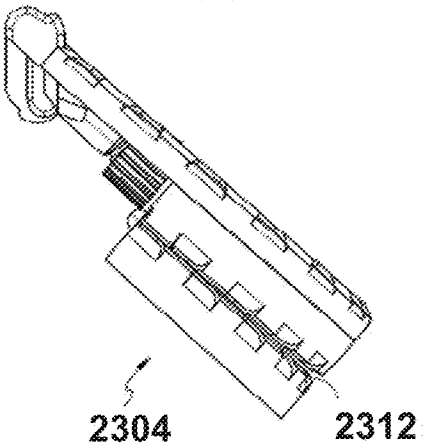
FIGS. 23A-23E illustrate various views of a shave gear.
Figure 23B:
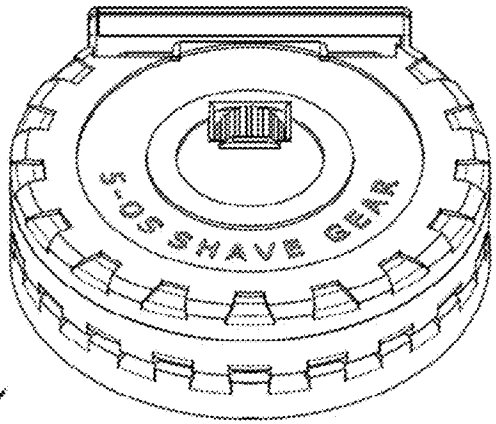
Figure 23A:
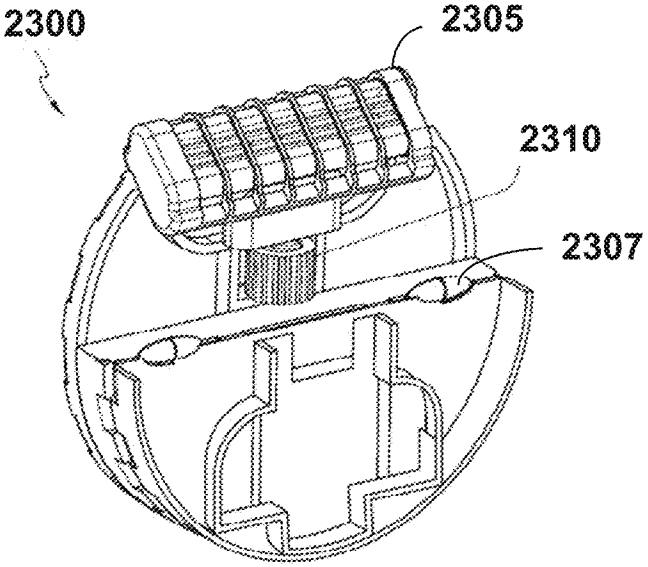
Figure 23E:
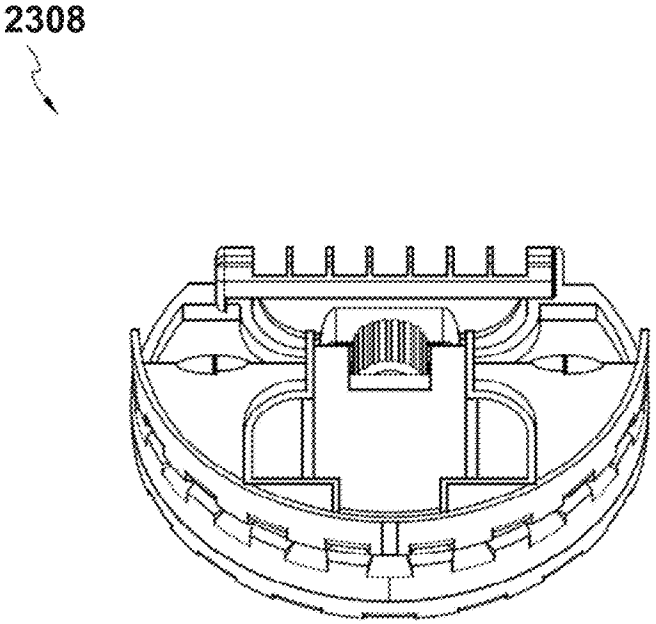
Figure 23D:
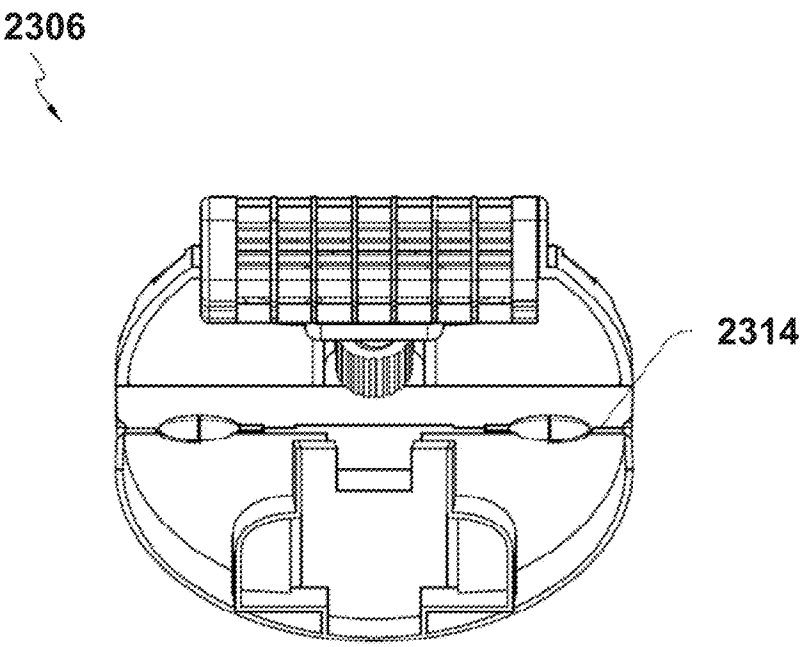
Figure 24C:
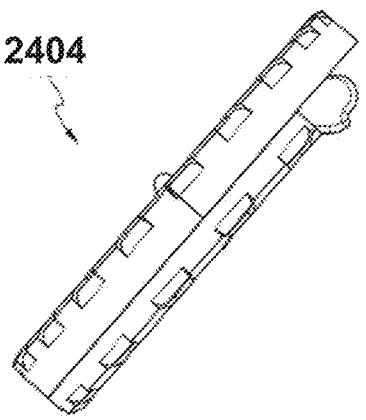
FIGS. 24A-24E illustrate various views of an adjustable and closeable shave gear.
Figure 24B:
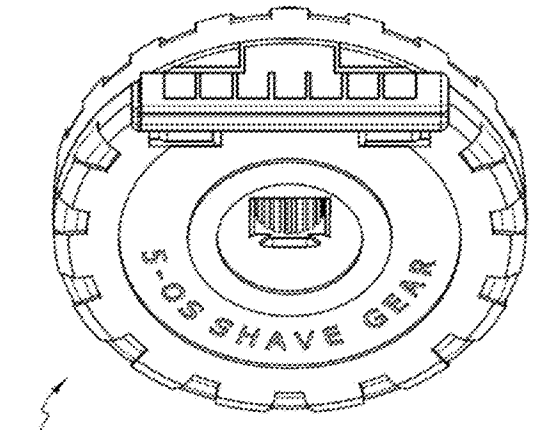
Figure 24A:
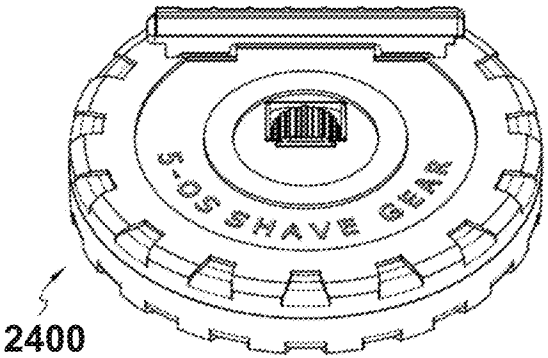
Figure 24E:
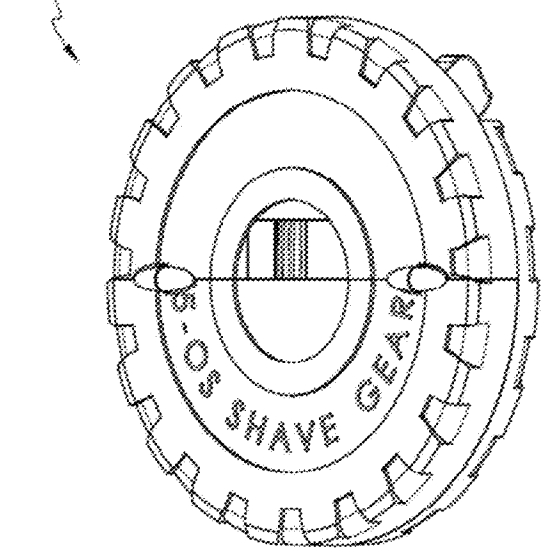
Figure 24D:
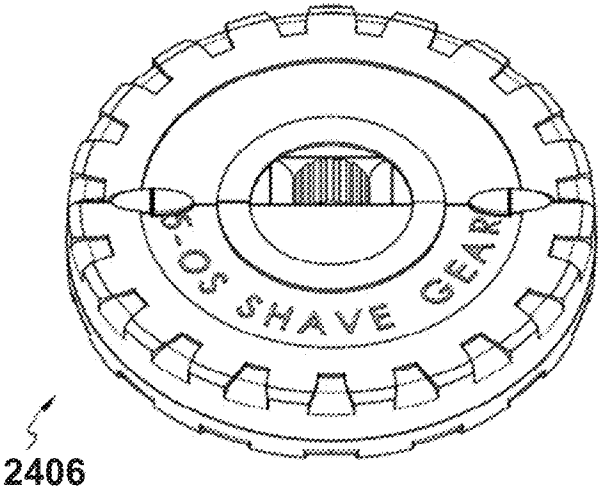

FIG. 22 shows an exploded view of the Shave Gear adjustable razor. It shows the adjustable dial 2224 that can be twisted which causes razor blade cartridge 2204 to move up and down. Razor blade cartridge 2204 is attached to the bottom of the razor cartridge 2236. The razor blade guard 2202 attaches to the razor cartridge. When a user twists adjustable dial 2224, the razor cartridge moves up or down, allowing for different lengths of hair to remain based on the user's preference.

Referring to FIG. 22, 2200 illustrates a full view of detached shave gear model. 2210 illustrates a backside of razor handle. 2226 illustrates a top of razor handle that catches and holds in place razor cartridge and guard. 2224 illustrates an adjustable dial that can be turned in order to move screw-like part 2222, which then forces razor blade cartridge 2204 up and down. 2222 illustrates a screw-like device which when twisted causes the razor blade cartridge 2204 to move up and down. 2208 illustrates a connection piece that attaches to the bottom of the razor blade cartridge 2236. 2236 illustrates a bottom of razor blade cartridge that connects to part 2208. 2204 illustrates a top and side view of razor blade cartridge.

2232 illustrates a side view of razor blade cartridge which is used to connect permanently or non-permanently to razor blade guard 2202. 2220 illustrates a top part of razor blade cartridge which is used to connect permanently or non-permanently to razor blade guard 2202. 2202 illustrates a top and side view of razor blade guard. 2234 illustrates an edge of razor blade guard which attaches to razor blade cartridge 2220.

FIGS. 23A-23E show a 180 Flip Shave Gear adjustable razor shown in its open state. This version can be opened and closed, revealing and hiding the razor blades respectively. This version is ideal for travel. It also provides for an adjustable shave, where the user can twist the dial to increase or decrease the distance between the hair being removed and the blade. Either the guard can be moved up and down the razor blades, or the cartridge. The cartridge can be removed and replaced with a new cartridge Referring to FIGS. 23A-23E, 2300 illustrates a shave gear that self-encloses. 2310 illustrates an adjustable dial that can raise or lower razor blade cartridge 2305. 2302 illustrates a closed view of the shave gear where the razor blade(s) are enclosed by handle 2312. 2304 illustrates an adjustable shave gear model shown in open state allowing for use of razor blade cartridge 2305. 2312 illustrates an adjustable razor handle that can rotate up and down on hinge 2307. 2306 illustrates a hinge that allows the adjustable part of the handle 2312 to open and close acting as a cover when in the closed state. 2306 illustrates an interior view of adjustable and closeable shave gear in open state. 2314 illustrates a hinge that allows for opening and closing of shave gear. 2308 illustrates a shave gear in half open state.

FIGS. 24A-24E show the rear, side and front view plus the perspective of the 5-OS 180 Flip Shave Gear in the closed state. Referring to FIGS. 24A-24E, 2400 illustrates a three quarter view of adjustable and closeable shave gear in a closed state. 2402 illustrates a front view of adjustable and closeable shave gear in closed state. 2404 illustrates a side view of shave gear in closed state. 2406 illustrates a three quarter view of adjustable and closeable shave gear assembly in closed state. 2408 illustrates a side view of adjustable and closeable shave gear assembly in closed state.

Figure 25:
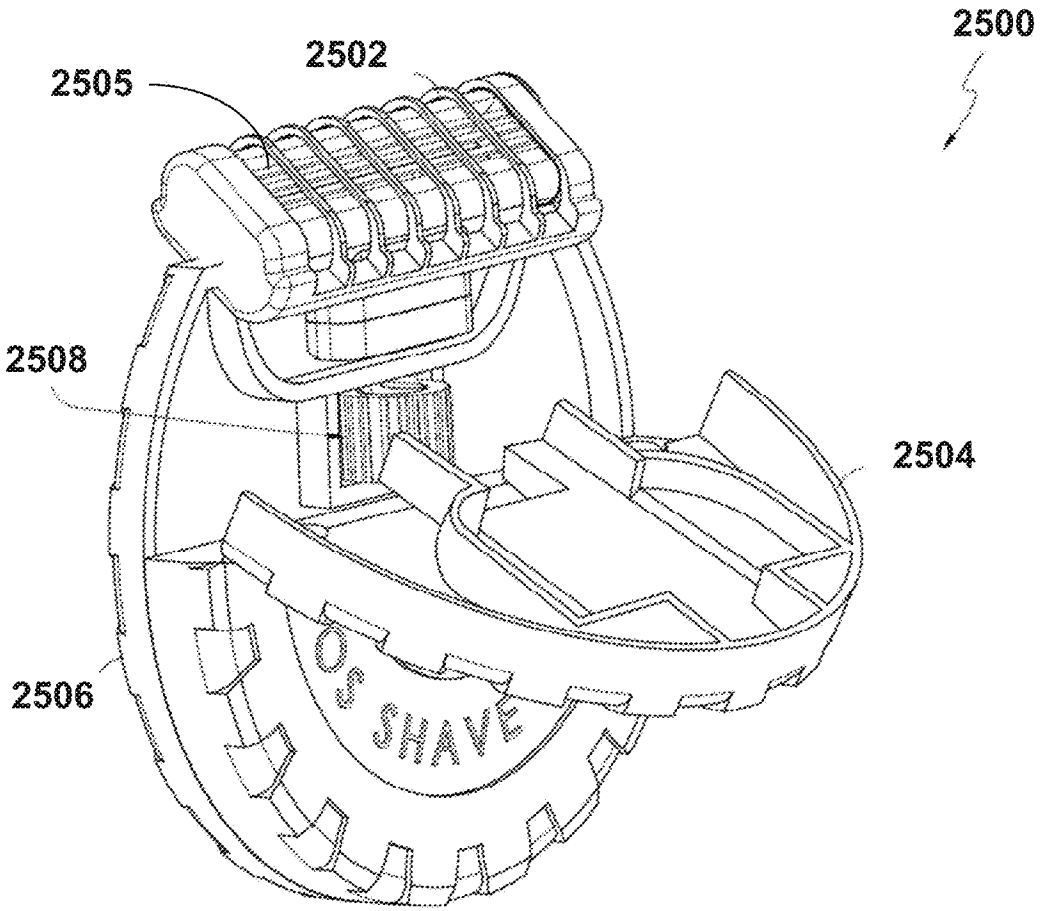
FIG. 25 illustrates an interior view of adjustable and closeable shave gear.
Figure 26C:
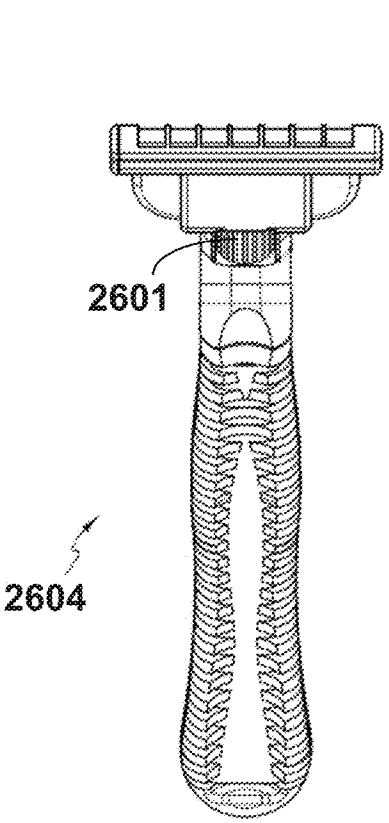
FIGS. 26A-26D illustrate various views of an example razor handle disclosed herein.
Figure 26B:
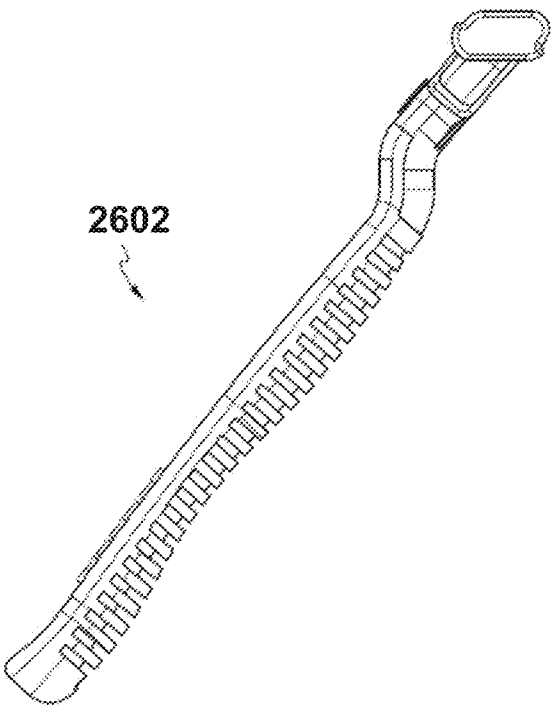
Figure 26A:
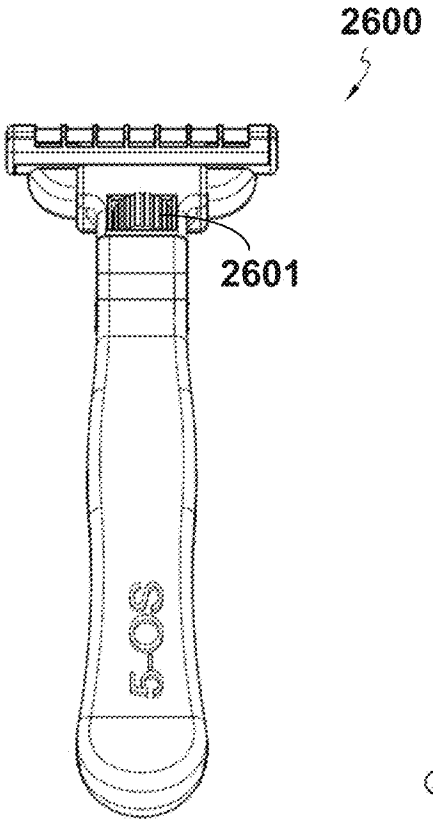
Figure 26D:
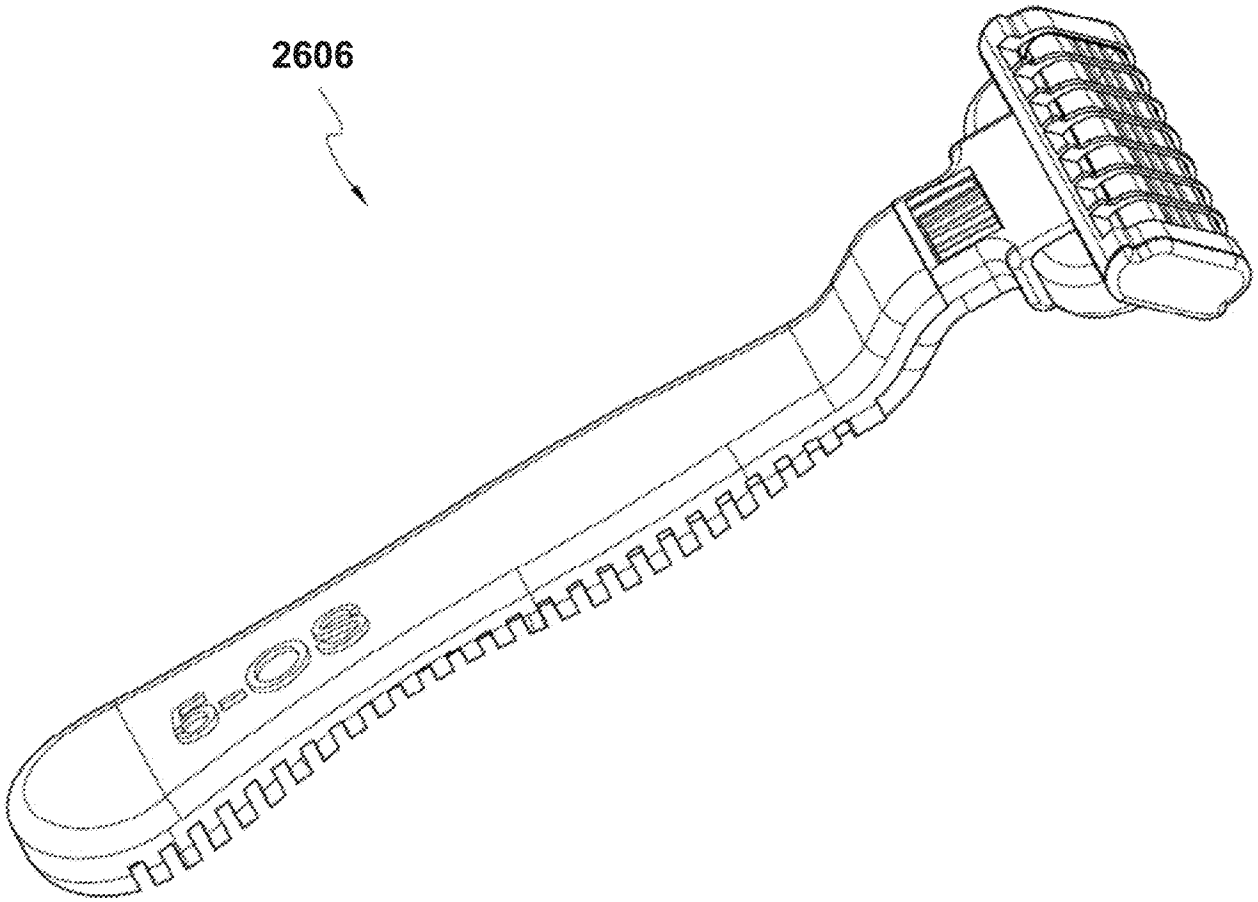

FIG. 25 shows the 180 Flip Shave Gear adjustable razor in the partially open state. The side wall that is partially open would be pushed down further until touching the bottom half of that same wall. The dial inside can be adjusted to allow for the desire amount of hair to be remaining after a shave. The dial may or not be exposed on the other side. If only exposed on the inside, the Shave Gear must be opened to allow for an adjustment of the razor blades, cartridge and/or razor guard. The top of the outer right wall can be closed to contain the razor blades, preventing injury, cutting or getting stuck on other items or possibly breaking.

Referring to FIG. 25, 2500 illustrates an interior view of adjustable and closeable shave gear in open state. 2502 illustrates a razor blade guard. 2506 illustrates a razor gear back cover. 2508 illustrates an adjustable dial which causes the razor blade cartridge 2505 to move up and down. 2504 illustrates a movable razor blade cover which opens and closes to uncover and cover respectively the razor cartridge 2505 and razor blade guard. 2502 illustrates an integrated blade guard.

FIGS. 26A-26D show the adjustable razor that is built into a standard razor handle. The dial can be twisted to move the razor cartridge up or down allowing the user to leave a predetermined amount of hair remaining from a shave. The cartridge can have either a permanently fixed razor blade guard or one that is attachable. In this figure it is permanently adhered to the razor cartridge. This figure shows the underside, side, top and perspective views.

Referring to FIGS. 26A-26D, 2600 illustrates the front view of a razor handle with a built-in feature allowing the user to adjust the razor blade(s) or razor blade cartridge to the desired level. 2601 illustrates the dial that can be twisted to cause the razor blade cartridge to move up and down. 2602 illustrates the side view of the razor handle with the built-in dial, razor blade cartridge and guard. 2604 illustrates the back view of the of the razor handle with the built-in dial, razor blade cartridge and guard. 2606 illustrates the front and side view of the razor handle with the built-in dial which allows the razor blade cartridge or razor blades to be adjustable in height relative to the razor guard.

Figure 27:
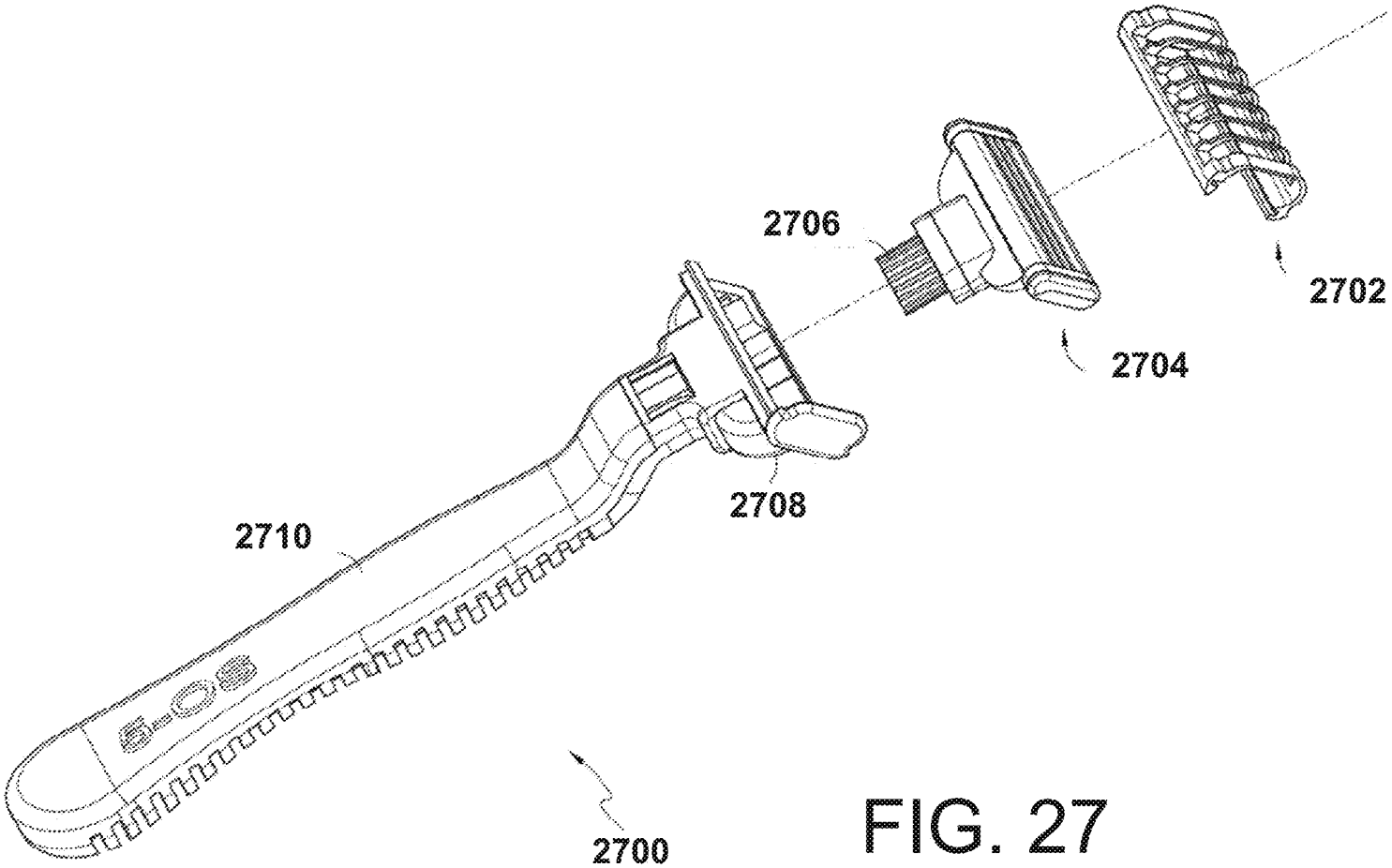
FIG. 27 illustrates an example assembly of the full razor handle with built in dial, the razor blade cartridge and guard.

FIG. 27 shows the stock blade assembly in an exploded view, showing the handle, stock blade receiver/carrier, the stock blade refill, the dial, and the 5-OS blade guard. Referring to FIG. 27, 2700 illustrates the assembly of the full razor handle with built-in dial, the razor blade cartridge and guard. 2702 illustrates the razor blade guard which can slide over, clip in, snap into or various other ways attach to the razor blade cartridge 2704. 2702 may also be permanently attached to razor blade cartridge 2704. 2706 illustrates the screw like mechanism and holder which is attached to 2704. 2706 illustrates a screw like mechanism that is rotated by the user to adjust the height of the razor blade cartridge 2704. In other assemblies, 2706 can cause 2702 to be adjusted in height. 2708 illustrates the body of the razor head and handle which houses 2704 the razor blade cartridge and 2706 the screw like mechanism. which adjust the height of the razor blade cartridge 2704. 2710 illustrates the top and side view of the razor handle with the built in dial.

Figure 28A:
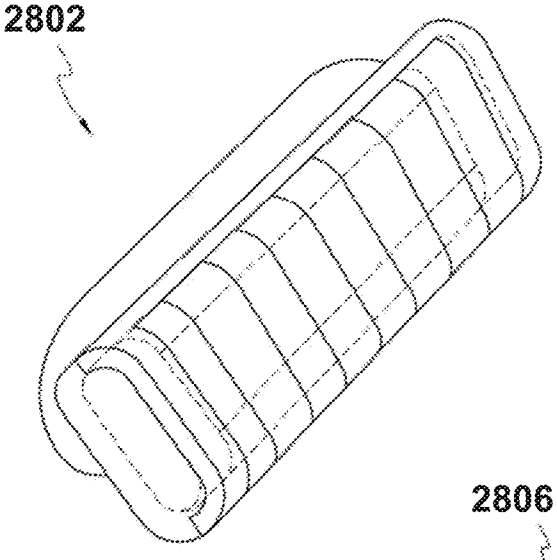
FIGS. 28A-28C illustrate alternate views of the assembly of the full razor handle with built in dial, the razor blade cartridge and guard.
Figure 28B:
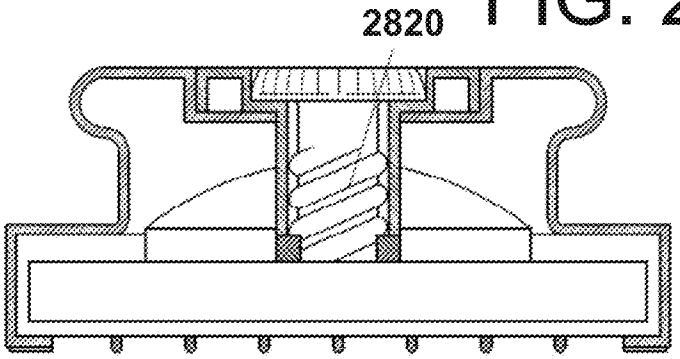
Figure 28C:
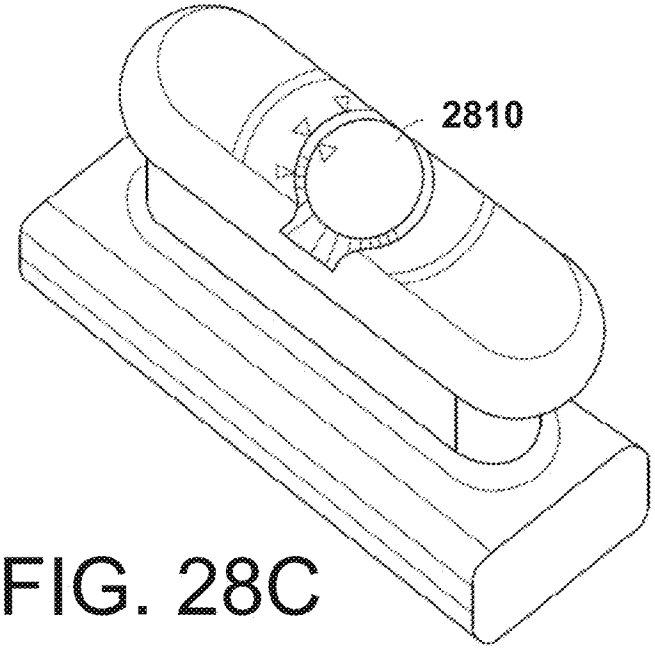

FIGS. 28A-28C show that adjustable razor assembly that resembles an ink stamp. The distance between the razor blades and the user's face can be adjusted in the handle and set to a predetermined length. There are indicia to allow the user to set the desired length. The razor blades move up and down based on the twist of the dial.

Referring to FIGS. 28A-28C, 2802 illustrates the bottom of this assembly showing the razor blade(s) and razor guard. 2806 illustrates the side view of this assembly showing the interior parts. 2820 illustrates the screw like mechanism which causes the razor blades or razor blade cartridge to move up and down. 2810 illustrates a dial used to control the height of the razor blade(s), razor blade cartridge or razor guard.

Although various implementations of the apparatus have been described above with a certain degree of particularity, or with reference to one or more individual implementations, those skilled in the art could make numerous alterations to the disclosed implementations without departing from the spirit or scope of the presently disclosed technology. It is intended that all matter contained in the above description and shown in the accompanying drawings shall be interpreted as illustrative only of particular implementations and not limiting. The implementations described above and other implementations are within the scope of the following claims.

The invention claimed is:

1. A manual razor assembly, comprising:

a manual razor cartridge, wherein the manual razor cartridge comprises:

a blade assembly comprising a plurality of blades; and a spacer mounted to and positioned over the blade assembly, wherein the spacer, in an upright position, comprises a first side wall, a second side wall, and a plurality of ribs positioned between the first side wall and the second side wall; and a handle attached to the manual razor cartridge;

wherein the plurality of ribs comprises:

a first plurality of ribs, each having a base disposed on a leading side of the manual razor cartridge and a free end having a tip that points towards a space above the plurality of blades of the blade assembly, wherein an upper surface and a lower surface of each of the first plurality of ribs are tapered in a direction from the base to the tip to form the tip of the free end; and a second plurality of ribs, each having a base disposed on a trailing side of the manual razor cartridge and a free end having a tip that points towards the space above the plurality of blades of the blade assembly, wherein an upper surface and a lower surface of each of the second plurality of ribs are tapered in a direction from the base to the tip to form the tip of the free end;

wherein the first and second pluralities of ribs are separated from one another by the space above the plurality of blades of the blade assembly;

wherein the upper surfaces of both the first and second pluralities of ribs provides a contact interface for a surface to be shaved, wherein the contact interface has a plane of contact spanning the first and second pluralities of ribs and the space above the plurality of blades of the blade assembly; and wherein the spacer and the blade assembly are arranged within the manual razor cartridge such that the distance between the sharpened side of the plurality of blades and the contact interface in a direction orthogonal to the plane of contact of the contact interface is at least 0.5 mm for leaving a predetermined amount of hair remaining after the manual razor cartridge is used for shaving.

2. The manual razor assembly according to claim 1, wherein the manual razor cartridge further comprises:

a knob configured for adjusting the distance between the sharpened side of the plurality of blades and the contact interface based on sliding of the knob to different positions corresponding to different distances.

3. The manual razor assembly according to claim 1, wherein the manual razor cartridge further comprises:

a dial configured for adjusting the distance between the sharpened side of the plurality of blades and the contact interface based on rotation of the dial to different positions corresponding to different distances.

4. The manual razor assembly according to claim 1, wherein the distance between the sharpened side of the plurality of blades and the contact interface is adjustable based on movement of the plurality of blades and/or based on movement of the spacer.

5. The manual razor assembly according to claim 1, wherein the distance between the sharpened side of the plurality of blades and the contact interface is in a range of 0.5 mm to 1 mm.

6. The manual razor assembly according to claim 1, wherein the distance between the sharpened side of the plurality of blades and the contact interface is in a range of 0.5 mm to 1.5 mm.

7. The manual razor assembly according to claim 1, wherein the distance between the sharpened side of the plurality of blades and the contact interface is adjustable.

8. The manual razor assembly according to claim 1, wherein the tips of the first plurality of ribs point towards the second plurality of ribs, and wherein the tips of the second plurality of ribs point towards the first plurality of ribs.

9. A manual razor cartridge, wherein the manual razor cartridge comprises:

a blade assembly comprising a plurality of blades; and a spacer mounted to and positioned over the blade assembly, wherein the spacer comprises a first side wall, a second side wall, and a plurality of ribs positioned between the first side wall and the second side wall;

wherein the plurality of ribs comprises:

a first plurality of ribs, each having a base disposed on a leading side of the manual razor cartridge and a free end having a tip that points towards a space above the plurality of blades of the blade assembly, wherein an upper surface and a lower surface of each of the first plurality of ribs are tapered in a direction from the base to the tip to form the tip of the free end; and a second plurality of ribs, each having a base disposed on a trailing side of the manual razor cartridge and a free end having a tip that points towards the space above the plurality of blades of the blade assembly, wherein an upper surface and a lower surface of each of the second plurality of ribs are tapered in a direction from the base to the tip to form the tip of the free end;

wherein the first and second pluralities of ribs are separated from one another by the space above the plurality of blades of the blade assembly;

wherein the manual razor cartridge is configured to be attached to a handle to form a manual razor assembly;

wherein the upper surfaces of both the first and second pluralities of ribs provides a contact interface for a surface to be shaved, wherein the contact interface has a plane of contact spanning the first and second pluralities of ribs and the space above the plurality of blades of the blade assembly; and wherein the spacer and the blade assembly are arranged within the manual razor cartridge such that the distance between the sharpened side of the plurality of blades and the contact interface in a direction orthogonal to the plane of contact of the contact interface is at least 0.5 mm for leaving a predetermined amount of hair remaining after the manual razor cartridge is used for shaving.

10. The manual razor cartridge according to claim 9, wherein the distance between the sharpened side of the plurality of blades and the contact interface is adjustable based on movement of the plurality of blades and/or based on movement of the spacer.

11. The manual razor cartridge according to claim 9, wherein the distance between the sharpened side of the plurality of blades and the contact interface is in a range of 0.5 mm to 1 mm.

12. The manual razor cartridge according to claim 9, wherein the distance between the sharpened side of the plurality of blades and the contact interface is in a range of 0.5 mm to 1.5 mm.

13. The manual cartridge according to claim 9, wherein the distance between the sharpened side of the plurality of blades and the contact interface is adjustable.

14. The manual razor cartridge according to claim 9, wherein the tips of the first plurality of ribs point towards the second plurality of ribs, and wherein the tips of the second plurality of ribs point towards the first plurality of ribs.

* * * * *